US010244809B2

(12) United States Patent
Linares et al.

(10) Patent No.: US 10,244,809 B2
(45) Date of Patent: Apr. 2, 2019

(54) HELMET FOR ATTENUATING IMPACT EVENT

(71) Applicant: Linares Medical Devices, LLC, Auburn Hills, MI (US)

(72) Inventors: Miguel A. Linares, Bloomfield Hills, MI (US); Miguel A. Linares, Jr., Bloomfield Hills, MI (US)

(73) Assignee: Linares Medical Devices, LLC, Auburn Hills, MI (US)

( * ) Notice: Subject to any disclaimer, the term of this patent is extended or adjusted under 35 U.S.C. 154(b) by 985 days.

(21) Appl. No.: 14/575,170

(22) Filed: Dec. 18, 2014

(65) Prior Publication Data

US 2015/0164172 A1 Jun. 18, 2015

Related U.S. Application Data

(60) Provisional application No. 61/917,708, filed on Dec. 18, 2013.

(51) Int. Cl.

| | |
|---|---|
| ***A42B 3/00*** | (2006.01) |
| ***A42B 3/06*** | (2006.01) |
| ***A42B 3/04*** | (2006.01) |
| ***A42B 3/18*** | (2006.01) |
| ***A42B 3/20*** | (2006.01) |

(52) U.S. Cl.

CPC ..... *A42B 3/065* (2013.01); *A42B 3/0473* (2013.01); *A42B 3/18* (2013.01); *A42B 3/20* (2013.01)

(58) Field of Classification Search

CPC ..... A42B 3/0473; A42B 3/121; A42B 3/124

See application file for complete search history.

(56) References Cited

U.S. PATENT DOCUMENTS

| | | | |
|---|---|---|---|
| 1,203,564 | A | 11/1916 | April |
| 2,634,415 | A | 4/1953 | Hattori |
| 2,881,442 | A | 4/1959 | Sowle |
| 3,186,004 | A | 6/1965 | Carlini |
| 3,283,336 | A | 11/1966 | Critser |
| 3,872,511 | A | 3/1975 | Nichols |
| 4,028,743 | A | 6/1977 | Christensen |
| 4,274,161 | A | 6/1981 | Littler |
| 4,287,613 | A | 9/1981 | Schulz |
| 4,324,005 | A | 4/1982 | Willis |
| 4,354,283 | A | 10/1982 | Gooding |
| 4,663,785 | A | 5/1987 | Comparetto |

(Continued)

FOREIGN PATENT DOCUMENTS

| | | | |
|---|---|---|---|
| GB | 2423006 | A | 8/2006 |
| GB | 2463258 | A | 3/2010 |

(Continued)

*Primary Examiner* — Khaled Annis
*Assistant Examiner* — Brieanna Szafran
(74) *Attorney, Agent, or Firm* — Dinsmore & Shohl LLP

(57) ABSTRACT

A force attenuating helmet construction including a rigid layer generally conforming to the wearer's head. A plurality of force absorbing and reacting portions extend from locations of the rigid layer such that, in response to an impact event experienced by the helmet, the absorptive and reactive forces minimize impact forces transferred to the user's head and spine. The helmet can include inner and outer rigid layers, or shells, and which are spatially supported by a plurality of force attenuating components.

12 Claims, 21 Drawing Sheets

(56) References Cited

U.S. PATENT DOCUMENTS 4,853,980 A 8/1989 Zarotti
5,083,320 A 1/1992 Halstead
5,136,657 A 8/1992 Hattori
5,175,889 A 1/1993 Infusino
5,263,203 A 11/1993 Kraemer et al.
5,734,994 A 4/1998 Rogers
5,956,777 A 9/1999 Popovich
6,378,140 B1 * 4/2002 Abraham ..... A42B 3/064 2/411
6,625,820 B1 * 9/2003 Lampe ..... A42B 3/00 2/171
6,996,856 B2 2/2006 Puchalski
7,076,811 B2 7/2006 Puchalski
7,328,462 B1 2/2008 Straus
7,603,725 B2 10/2009 Harris
8,256,033 B2 9/2012 Arai
8,341,771 B2 1/2013 Lee
8,719,967 B2 5/2014 Milsom
8,739,317 B2 6/2014 Abernethy
8,856,972 B2 10/2014 Kirshon
8,898,818 B1 12/2014 Whitcomb
9,642,410 B2 * 5/2017 Grice ..... A42B 3/06
9,949,523 B2 4/2018 Klein et al.
2006/0059606 A1 * 3/2006 Ferrara ..... A01N 25/18 2/412
2007/0151003 A1 7/2007 Shih
2008/0250548 A1 * 10/2008 Stuhmiller ..... A41D 13/0155 2/413
2008/0256686 A1 10/2008 Ferrara
2009/0260133 A1 10/2009 Del Rosario
2010/0083424 A1 * 4/2010 Linares ..... A42B 3/0473 2/413
2011/0131695 A1 * 6/2011 Maddux ..... A42B 3/18 2/9
2011/0209272 A1 9/2011 Drake
2012/0204329 A1 8/2012 Faden et al.
2012/0297526 A1 11/2012 Leon
2013/0000015 A1 * 1/2013 Marzec ..... A42B 3/064 2/411
2013/0007950 A1 1/2013 Arai
2013/0061371 A1 3/2013 Phipps et al.
2013/0111654 A1 5/2013 Gorsen et al.
2013/0152286 A1 6/2013 Cormier et al.
2013/0152287 A1 6/2013 Cormier et al.
2013/0174331 A1 * 7/2013 Witcher ..... A42B 3/122 2/413
2013/0254978 A1 10/2013 McInnis et al.
2013/0312161 A1 11/2013 Anderson et al.
2013/0340150 A1 12/2013 Brantley
2014/0000012 A1 1/2014 Mustapha
2014/0007326 A1 1/2014 Nelson
2014/0020157 A1 1/2014 Barr
2014/0020158 A1 1/2014 Parsons et al.
2014/0033402 A1 2/2014 Donnadieu et al.
2014/0068841 A1 * 3/2014 Brown ..... A42B 3/122 2/413
2014/0173810 A1 6/2014 Suddaby
2014/0298572 A1 10/2014 Mazzoccoli
2014/0325744 A1 11/2014 Klein et al.
2014/0331392 A1 11/2014 Cleva
2015/0101899 A1 * 4/2015 Russo ..... B33Y 80/00 188/266
2015/0135413 A1 5/2015 Mayerovitch
2016/0128415 A1 5/2016 Tubbs

FOREIGN PATENT DOCUMENTS

JP 2013019067 A 1/2013
WO 2014177872 A1 11/2014

* cited by examiner

HELMET FOR ATTENUATING IMPACT EVENT

CROSS-REFERENCE TO RELATED APPLICATIONS

This Application claims the benefit of U.S. Provisional Application 61/917,708 filed on Dec. 18, 2013, the contents of which are incorporated herein in its entirety.

FIELD OF THE INVENTION

The present invention is directed to a variety of helmet designs incorporating active force cushioning and redirection structure for absorbing the effects of an impact event in a manner which minimizes damage to the wearer's skull and upper cervical spinal vertebrae. In particular, the present inventions include a first helmet incorporating a plurality of inner supported ballasting and force absorption components integrated into the helmet. This includes each of a top/crown mounted pancake style cylinder for protecting the top of the head, an upper inner perimeter encircling ring array of impact baffle portions for protecting the skull, a pair of cheek/zygomotic bone cushioning supports, each of these incorporating a bunch of stem supported and modified bulbous deflecting portions.

Also incorporated into the first helmet configuration are a plurality of three lowermost periphery mounted spring supported portions extending externally about the sides and rear of the lowermost edge of the helmet. An inner extending and lower rear head support portion is located below the upper perimeter ring array for protecting the rear base of the skull and spinal column.

A further helmet embodiment incorporates inner and outer rigid layers or shells, between which are supported a variety of cushioning force absorption and redirectional components. Mounting locations of an associated face mask to sides of the outer helmet can also include pairs of bidirectional compression springs for providing bi-directional force dissipating displacement of the mask, such as in response to a pulling or pushing force.

BACKGROUND OF THE INVENTION

The prior art is documented with numerous examples of impact absorbing and protecting helmet designs. The objective in each instance is to provide a head and neck protection to the wearer.

A first example is the shock balance controller of Harris, U.S. Pat. No. 7,603,725 and which teaches a support structure having a chamber including a port disposed in a side of the chamber, the port providing an opening to a housing, and a bladder coupled to the housing, the bladder being filled with a first material configured to receive pressure from a shock, wherein the first material, when receiving the shock pushes a first piston that compresses a spring disposed in the housing, the spring pushing a second piston that increases the pressure of a second material stored in the chamber. A shock balance controller may also include a structure configured to support the shock balance controller, the structure having a chamber, a port, and a housing assembly, and a bladder coupled to the structure using the housing assembly, the bladder and housing assembly being configured to transfer energy between the bladder and the chamber.

Anderson, US 2013/0312161, teaches an impact energy attenuation material, impact energy attenuation module employing the material and a fit system for optimizing the performance thereof is provided. Non-linear energy attenuating material consisting of a plurality of loose particles is employed for impact energy dissipation. The loose particles are preferably spherical elastomeric balls. An impact energy attenuation module includes a container that holds the loose particles. The impact energy attenuation module can be provided in a wide range of sizes and shapes and the loose particles can be provided in different materials, sizes, density, compaction and hardness to suit with the application at hand. A matrix of impact energy attenuation module are provided about the surface of a shell to provide the required impact energy attenuation. The material, impact energy attenuation module and system of the present invention are well suited for protection of body parts and other cushioning and protection needs.

Abernathy, U.S. Pat. No. 8,739,317, teaches a liner adapted to be interposed between the interior surface of a protective headgear and a wearer's head and includes a plurality of networked fluid cells adapted to distribute and dissipate an impact force to the liner, and/or headgear with which the liner is used, across a larger area of the wearer's head as compared with the impact location, and also to dampen the tendency of the wearer's head from rebounding back from the impact location by transferring fluid through the network from fluid cells at the impact location to those in an opposed region. Discrete fluid cells interspersed among the networked fluid cells maintain the liner and/or the headgear in a predetermined orientation on the wearer's head. Fluid flow within the liner may be restricted or directed by configuring the fluid passageways. A liner may further include means for moving fluid into or out of the fluid cells.

Suddaby, US 2014/0173810, teaches a protective helmet having multiple zones of protection suitable for use in construction work, athletic endeavors, and similar activities. The helmet includes a hard outer protective that is suspended over a hard anchor zone by elastic bladders are positioned in the elastomeric zone and bulge through one or more of a plurality of apertures located in the outer zone. In one embodiment, an additional crumple zone is present. The structure enables the helmet to divert linear and rotational forces away from the user's braincase.

Also referenced is the helmet structure of Brown, US 2014/0068841, without any hard outer shell and which has axially compressible cell units contained in a hemispheric frame by a thin fabric covering stretched over cup shaped cell retainers that have sidewalls of compressible foam. The frame is supported on the wearer's head on plastic foam posts that space the inner ends of compressible bladders from the wearer's head, and ambient air in the bladders compresses at impact, being vented then through openings for gradually absorbing such impact forces. Each bladder is vented into a space between the cup "bottom" and the outer end of a bladder. At least two cell sizes are provided, and some of these are on depending lobes in the frame, for protecting the wearer's ears and neck.

SUMMARY OF THE INVENTION

The present invention teaches a force attenuating helmet construction including a rigid layer generally conforming to the wearer's head. A plurality of force absorbing and reacting portions extend from locations of the rigid layer such that, in response to an impact event experienced by the helmet, the absorptive and reactive forces minimize impact forces transferred to the user's head and spine.

The force absorbing and reacting portions further include at least one exterior mounted cushioning member supported along a lower rim edge of the rigid layer via a plurality of dynamic force absorbing and counter exerting springs. This can further include a plurality of three cushioning portions, each exhibiting an inner contoured surface from which extends the springs in spaced apart fashion, the cushioning members collectively projecting from the lower rim of a rigid wearable shell in a manner which facilitates attenuating the bending motions of the user's head relative to the neck and spine which are associated with an impact event.

Other features include a combination of internal supported cushioning components associated with the rigid layer and including at least one of a top inner located compressible bladder, an inner and intermediate extending cushioning ring, a pair of cheek (zygomotic) bone located cushioning support members, and a lower and rear perimeter extending ring supported upon the inside of the rigid layer. The top inner bladder may further exhibit a pseudo pancake configuration with upper and lower flattened portions which are interconnected by an intermediate bridging stem portion, the top inner bladder providing controlled collapse and reformable valving structure such that a hollow interior associated with the bladder deforms in a force attenuating fashion, following which it self-refills and resets with a ballasting fluid.

The intermediate extending cushioning ring further includes a plurality of individual collapsible portions provided in a circular ring array, each of the collapsible portions exhibiting a soft plastic or like material and which includes a baffled or controlled collapsing structure. The innermost portion associated with the lower spring biased cushioning member further has an outer foam or like body which encapsulates a plurality of interconnected interior baffles formed in a generally arcuate array, a series of vents or valve locations being formed in spaced fashion around the body and which respond to compression resulting from the impact event by discharging air or like fluid in a controlled collapsible and force attenuating fashion.

Yet additional features include the pair of cheek (zygmotic) bone located cushioning support members each further having a planar base, from an inner surface of which projects an array of stem supported compressible portions upon which are mounted increased diameter annular portions. In response to compressive forces exerted by the wearers cheek bones to the pad shaped cushioning members, the end-mounted annular portions deform in a collective combined bending and compressing fashion such that the force of the check bone causes the stem supported portions to increase (widen) their collective diameter dimensions in a counter force attenuating fashion.

Other features include the rigid layer further defining an inner rigid layer with inner support locations which are configured to closely conform to the user's skull, and outer spaced rigid layer being resiliently secured to the inner rigid layer via a plurality of flexible and elastic support tendons extending between the spaced apart inner and outer rigid helmet layers such that, in response to an impact event, the outer rigid layer deflecting relative to the inner layer by virtue of either stretching or compressing one or more selected support tendons. The elastic support tendons each further exhibit a generally polygonal cross sectional shaped intermediate stem terminating in flattened engaging portions which can be mechanically or chemically secured to opposing surface locations of the outer and inner rigid layers.

Yet additional embodiments include the outer spaced rigid helmet layer being resiliently secured to the inner rigid helmet layer via a structural force absorbing foam insert positioned or arranged in spatially defining fashion between the inner and outer rigid layers. Additional spatially supporting and force absorbing components can also be provided in the form of plasticized supporting components such as including a column support extending between the layers and, upon the outer helmet experiencing an impact event, providing for multi-directional energy absorbing properties.

Other reconfigurations of the inner/outer helmet spatially supporting/force absorbing components include each of an outer disk, an outer disk in combination with an inner integrally configured cross configuration, an internally hollow sphere, and an arrangement of first and second disks configured in rotatably offset and overlapping/intersecting fashion. Further features include a face mask mounted at multiple locations to the outer helmet and incorporating a dual compression spring arrangement associated with each mounting location for bi-directional force absorbing displacement.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As previously described, the present invention is directed to a variety of helmet designs incorporating active force cushioning and redirection structure which is constructed in order to both absorb and actively redirect the effects of an impact event in a manner which minimizes damage to the wearer's skull and upper cervical spinal vertebrae. The helmet designs, described in more detail with reference to FIGS. 1-26, are further constructed to provide enhanced force absorption associated with an impact event, combined with dynamic counter force generating, or reactive, properties (such as which are facilitated by springs or other internal structure) to further ameliorate the effects of the resultant forces resulting from the impact event.

Figure 1:
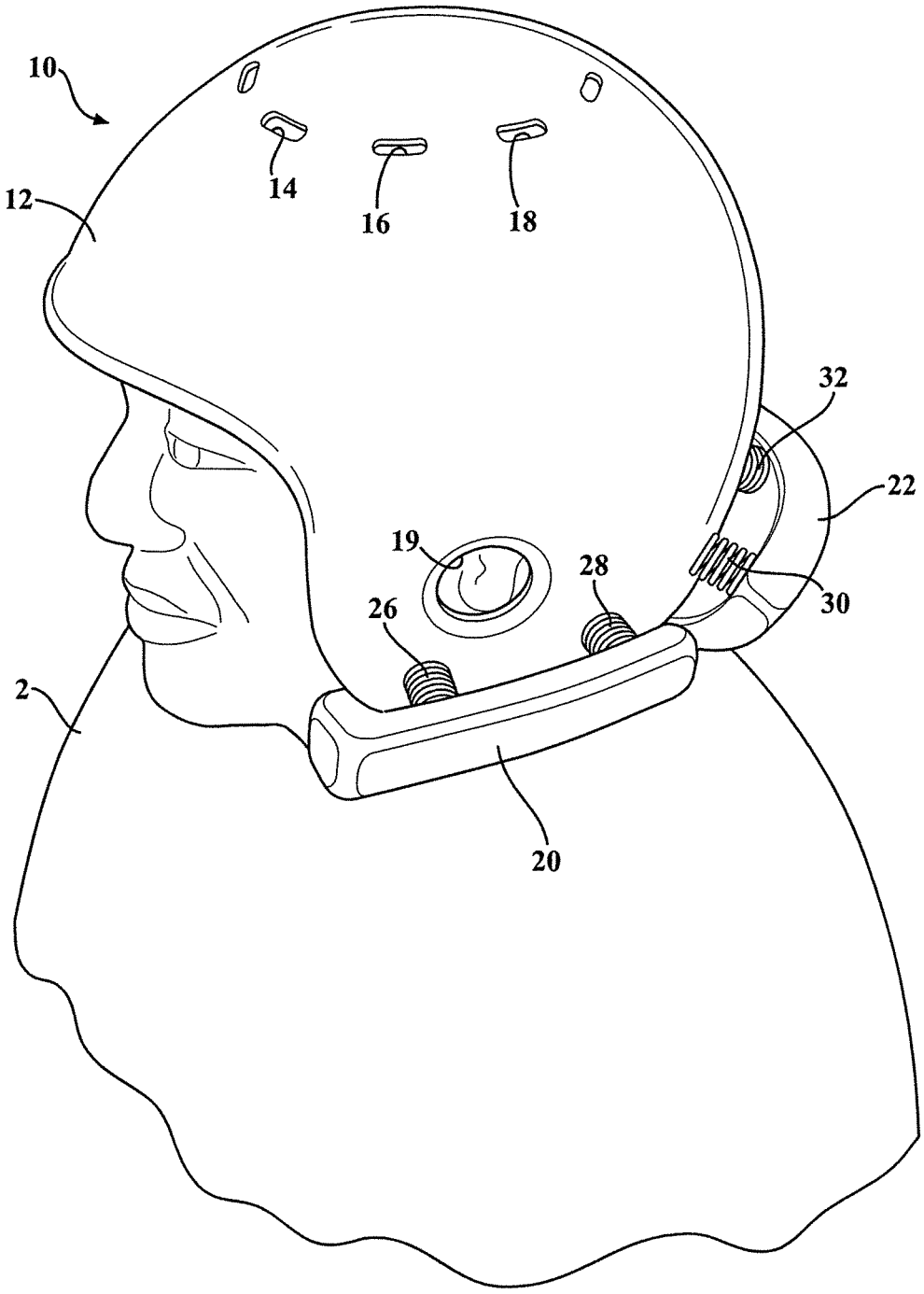
FIG. 1 is a perspective view of a helmet construction according to a first embodiment and illustrating a ventilated outer shell in combination with a lower rim projecting and spring biased cushioning member for attenuating the bending motions of the head relative to the neck and spine which are associated with an impact event.
Figure 3:
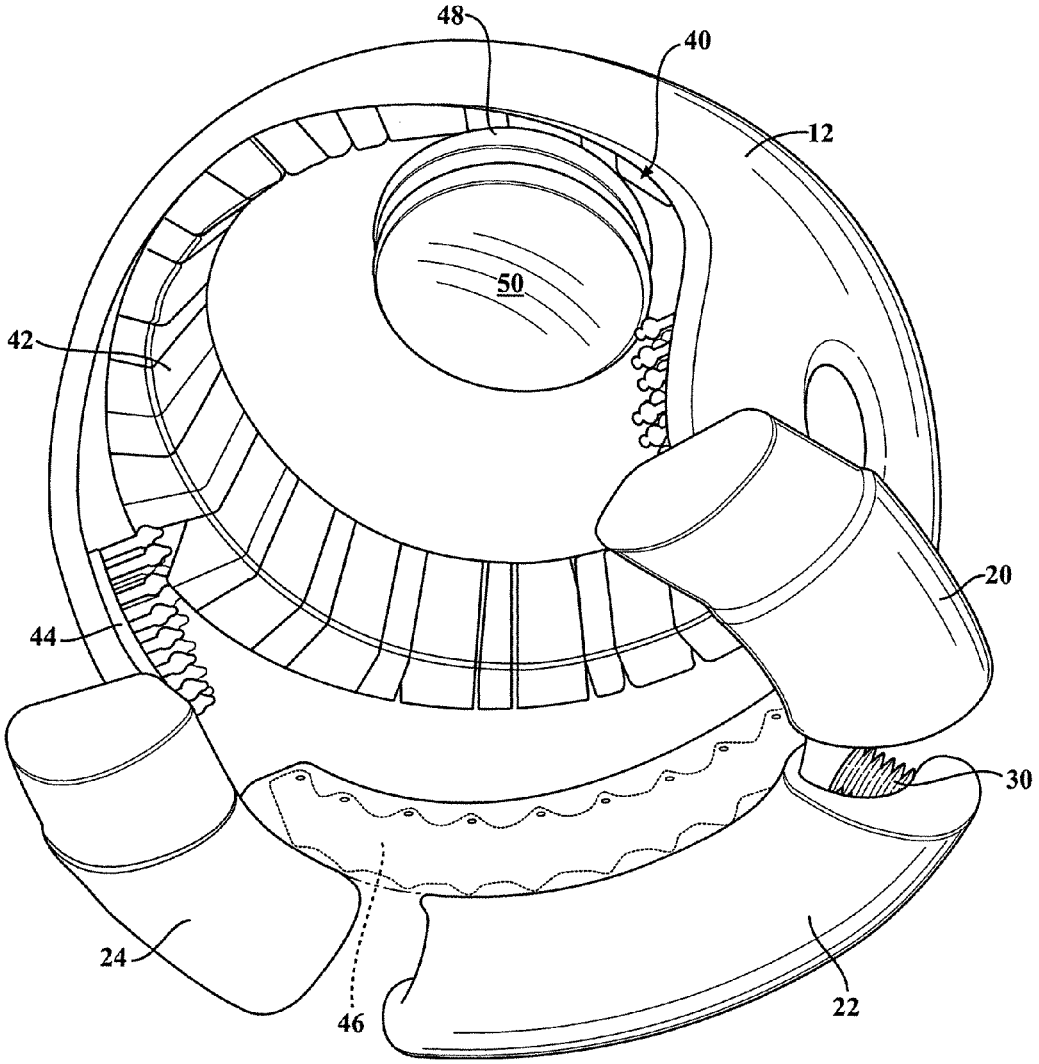
FIG. 3 is an underside rotated view of the helmet in FIG. 1 and illustrating the combination of inner cushioning components of FIG. 2 in combination with the outer lower rim cushioning member.

FIG. 1 is a perspective view, generally at 10, of a helmet construction according to a first embodiment which is worn upon the head of an individual 2. As also illustrated in FIG. 3, the helmet includes a rigid outer shell 12 and which is appropriately configured so as to be placed over the head of the wearer and illustrating appropriate ventilated locations, see inner rim defined apertures 14, 16, 18 et seq., formed in an upper or crown portion of the rigid shell. Additional apertures in the rigid shell are provided, such as ear hole locations at 19. Without limitation, the shell 12 can be constructed of any type rigid and impact resistant plastic, carbon fiber or composite thereof.

As best shown by the underside rotated perspective of FIG. 3, a lower rim projecting cushioning member is provided and includes one or more (three shown) rim extending portions 20, 22 and 24 which are secured to lower rim extending locations of the rigid shell 12 via individual sets of support springs, these shown in FIG. 1 by springs 26 and 28 for supporting cushioning portion 20, springs 30, 32 and 34 (FIG. 4) for supporting cushioning portion 22, and finally springs 36 and 38 for cushioning portion 24. The springs are supported upon inner contoured surfaces of each cushioning member 20, 22 and 24 in spaced apart fashion (as again best shown in FIG. 4) and so that the spring biased cushioning members collectively project from the lower rim of the rigid wearable shell 12 in a manner which facilitates attenuating the bending motions of the head relative to the neck and spine which are associated with an impact event, and as will be further described.

Without limitation, the cushioning portions 20, 22 and 24 can be constructed of any semi-soft or other suitable material, such as which can include an inner support portion, around which can be formed an outer cushioning portion. As further best shown in FIG. 4, the cushioning portions 20, 22 and 24 each exhibit an arcuate elongated configuration with a substantially "U" shape in cross section and so that the cushioning portions are cupped as shown by an inside "U"

shaped surface 27 depicted for selected portion 22. In this manner, and as further shown in FIGS. 9-11, the cushioning portions 20, 22, 24 are secured, via their springs, to the rigid shell so that an extending bottom rim edge of the rigid shell 12 is positioned within the cupped interior of each of the portions 20, 22 and 24 so that each of the portions 20, 22, 24 project both interiorly and exteriorly from the lower rim edge of the rigid shell, such also shown in the underside perspective of FIG. 3. As shown, the intermediate/middle cushioning portion 22 exhibits an open channel along its entire arcuate lengths, the with outer portions 20 and 24 having closed front ends, see at 21 and 25, respectively, and which overlay the bottom rim of the rigid shell 12 at the front side locations.

As further shown, the springs 26-38 anchor to exterior lower rim proximate locations of the rigid shell 12 and extend outwardly (and as further shown in FIG. 4 in a slightly upwardly angled fashion) to inner side locations of each "U" shape configuration in order to support the cushioning portions 20, 22 and 24. This can further include the outwardly projecting ends of the springs being anchored to the inner support portion of each cushioning member and, in this manner, the cushioning portions are adequately structurally supported to the helmet's rigid shell in a force absorbing and counter force generating fashion. Alternative to the springs shown, it is also envisioned that any other cushioning member supporting and counterforce generating components can be utilized, these not limited to any other type of spring, air pressure generating/cushioning device or the like.

Figure 2:
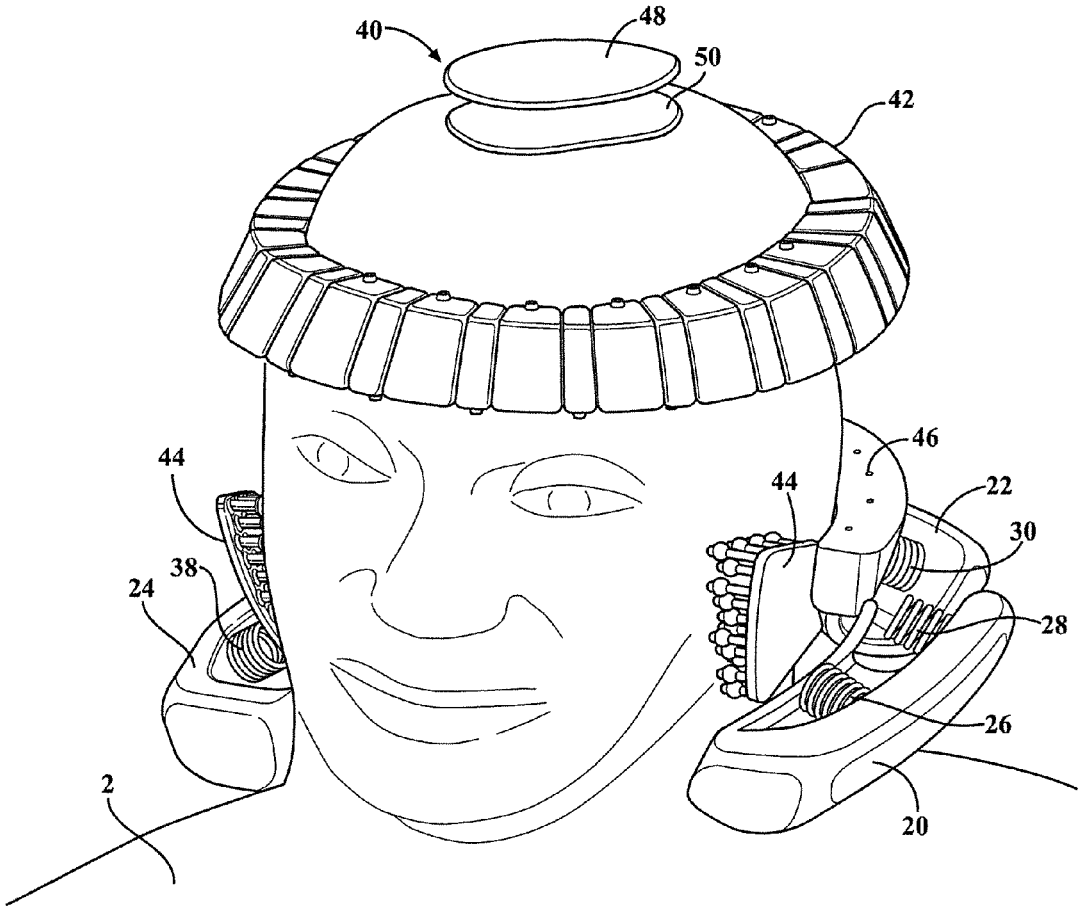
FIG. 2 is a perspective view of the helmet of FIG. 1 removed and which illustrates a combination of additional and internal cushioning components associated with the present design and including a top inner located compressible bladder in combination with an inner and intermediate extending cushioning ring, along with cheek (malar or zygmotic) bone located cushioning support members.

FIG. 2 is a perspective view similar to FIG. 1 with the rigid shell 12 removed and which illustrates a combination internal cushioning components associated with the present design. These include such as a top inner located compressible bladder, generally at 40 (also termed a pancake bladder as will be further described), in combination with an inner and intermediate extending cushioning ring 42 about an upper perimeter/periphery of the skull, and along with cheek (zygomotic) bone located cushioning support members (pair at 44). Additional internal cushioning components include a lower and rear perimeter extending ring 46 supported upon the inside of the rigid shell 12 for supporting the rear base of the skull and the upper connecting location of the spinal column.

Figure 4:
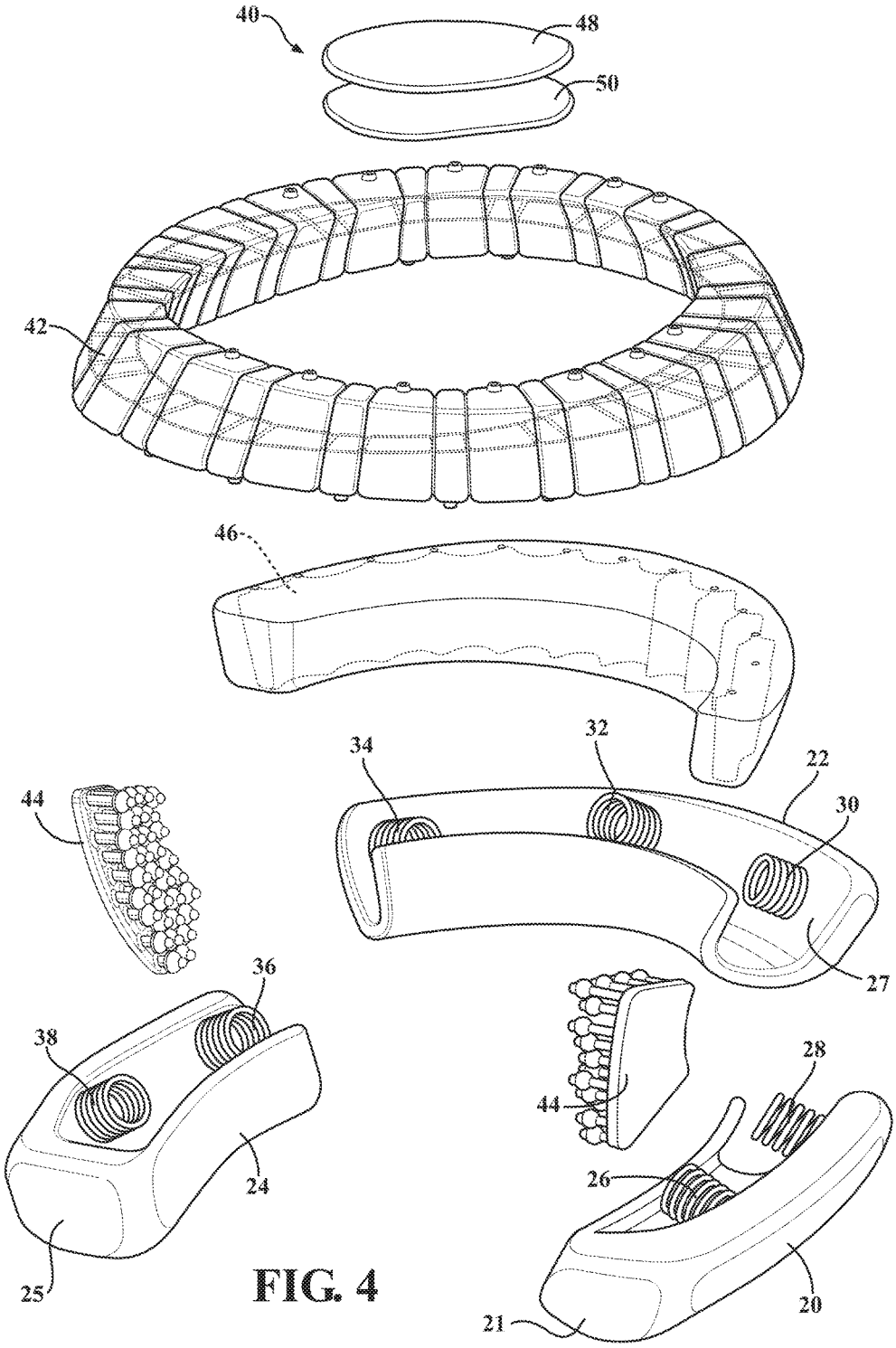
FIG. 4 is a spatially perspective arrayed illustration similar to FIG. 2 with the wearer's head, neck and upper extremities removed and better illustrating the support configuration collectively provided by the collection of inner and outer supporting portions in combination with the hard shell.
Figure 8:
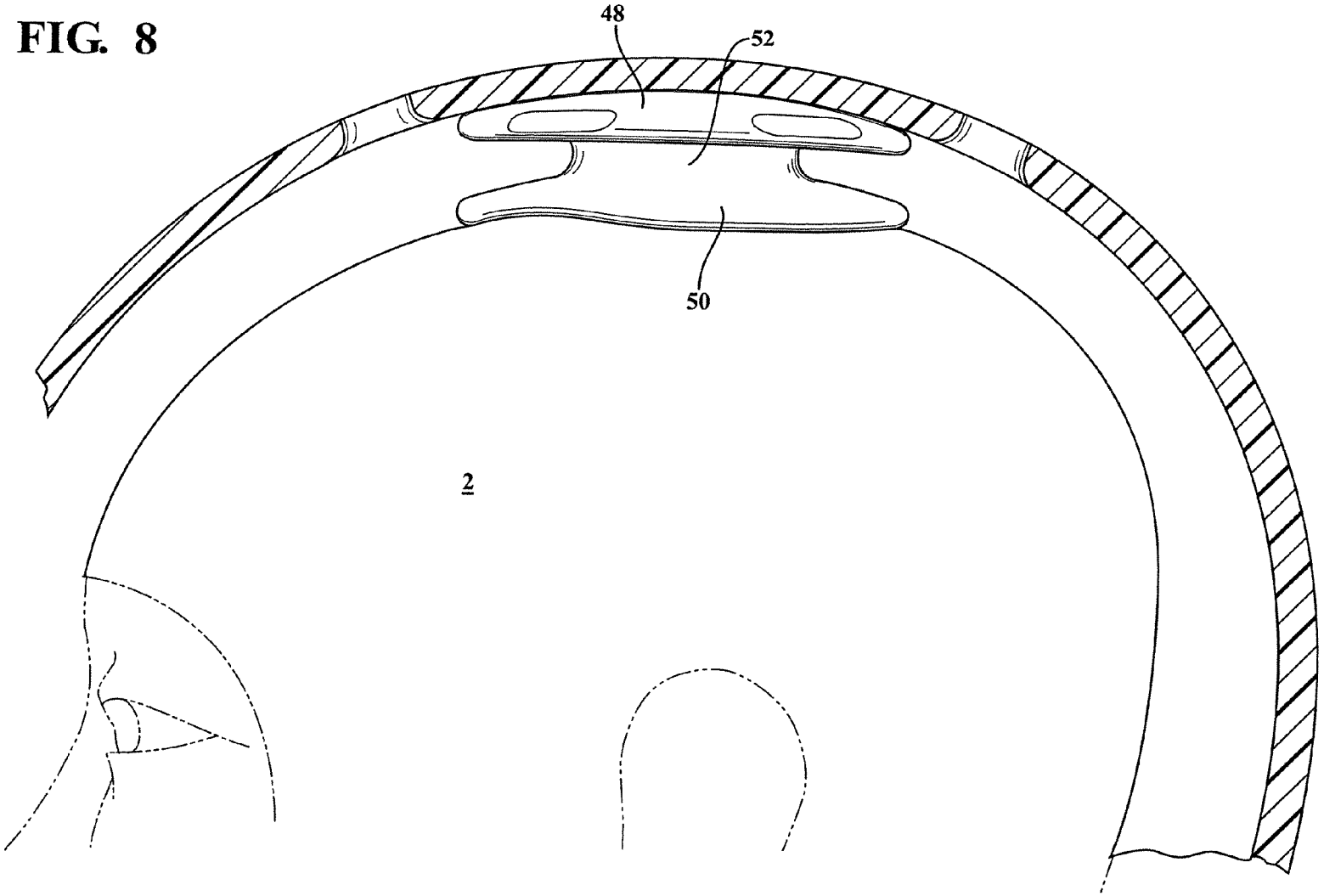
FIG. 8 is a side illustration showing the rigid helmet in partial phantom and illustrating the pseudo pancake configuration of the top inner located compressible bladder with upper and lower flattened portions and intermediate bridging stem portion.

As shown in each of FIGS. 2-4 and, as best shown in the phantom side illustration of FIG. 8, the bladder 40 exhibits a pseudo pancake configuration with upper 48 and lower 50 flattened portions which are interconnected by an intermediate bridging stem portion 52. The top inner pancake style bladder is intended to provide cushioning for the top of the wearer's head and, as described above, can incorporate any style of inner cylinder or air intake/outflow bladder as well as any other style of controlled collapse and reformable valving structure such that the body with hollow interior can deform in a force attenuating fashion, following which it self-refills and resets with a ballasting air volume. Although not shown, the pancake bladder can include any other configuration of bi-directional valving for communicating the exterior of the bladder to its hollow interior and in order to provide controlled collapsing discharge in response to a top head impact event, in combination with subsequent self-refilling and re-expansion of the bladder.

The material construction of the top pancake bladder 40 is further such that it can be formed of any soft plastic (can also include but is not limited to a thermoplastic elastomer or thermoplastic vulcanizate) or can include other suitable material including any type of solid (including a foam) or other suitable material. Other features associated with the pancake style bladder include the ability to substitute the air vent and valve structure with any other fluid medium. This can further include utilizing a liquid coolant as a force attenuating medium for any or all of the inner helmet cushioning portions and which can provide the dual function of assisting in cooling the head of the wearer. Alternately, and in very cold weather (environment) sport or non-sport applications, the liquid held within the bladder or other cushioning member can provide for warming/heating of the wearer's head.

Figure 7:
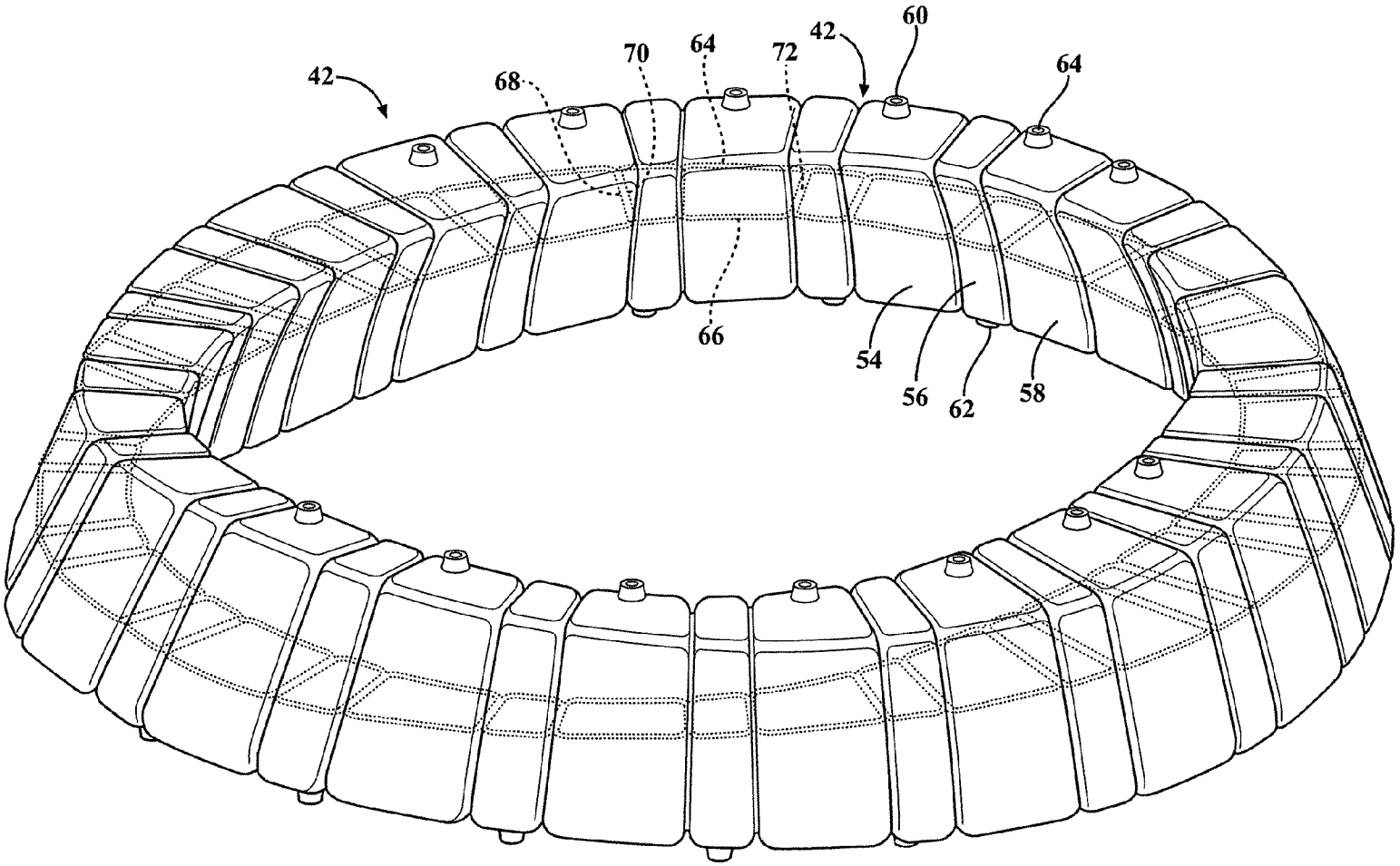
FIG. 7 is an enlarged perspective of the inner intermediate extending cushioning ring and which likewise illustrates control collapse baffling structure for responding to compressive forces associated with an impact event.

The inner and intermediate extending cushioning ring 42 is best shown in FIG. 7 and which likewise illustrates control collapse baffling structure for responding to compressive forces associated with an impact event. A plurality of individual collapsible portions, at 54, 56, 58 et seq., are provided in a circular ring array. Each of the collapsible portions exhibits a soft plastic or like material and which includes a baffled or controlled collapsing structure as depicted by valves or vents 60, 62 and 64, respectively, these further being shown in alternating top and bottom depiction associated with selected individual portions 54, 56, 58, et seq.

The cross sectional profile of the intermediate cushioning ring array is best depicted in FIG. 7 in line art depiction, with the understanding that this can also depict an inner circular support structure provided by spaced apart and circular extending wires or tensioning cables 64 and 66, between which are configured crosswise extending and spaced apart (interconnecting) wires or cables 68, 70, 72 et seq. As shown, the configuration of a suitable support structure is such that it provides additional connecting and reinforcing support to the skull encircling cushion ring 42, the perimeter surrounding cable configuration corresponding to the profile of the individual collapsible portions 54, 56, 58 et seq., such that the structure can provide an additional degree of structural support to the assembly. Without limitation, the cable extending support structure shown can alternately include the use of plastic tensioning elements which can be in-molded with the intermediate cushioning ring array 42 in order to provide structural integrity to the array.

As with the top pseudo pancake style bladder 40, the intermediate cushioning ring can incorporate controlled collapse and refill/reform properties utilizing any type of fluid medium (air, liquid etc.) and which establishes a desired degree of force attenuation/counter force generating functionality. The intermediate/cushioning ring array 42 can also be constructed of any type of compressible gel or foam. The cushioning ring 42 (also termed an impact pad) can also be produced individually or in combination with either or both of the face pads 44 or the lower inner rim extending cushioning ring 46.

Figure 6:
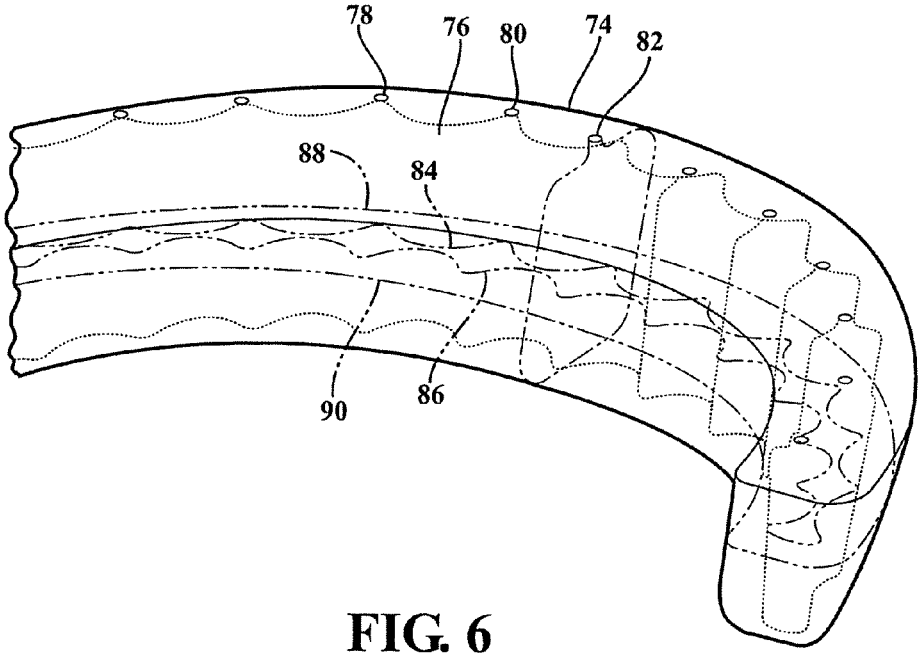
FIG. 6 is a phantom perspective of an innermost portion associated with the lower spring biased cushioning member and which exhibits interior baffles with control collapse venting, around which is configured a soft foam material.

As best shown in FIG. 6, a phantom perspective of an innermost portion associated with the lower spring biased cushioning member 46 is shown and includes an outer foam or like body 74 which encapsulates a plurality of interconnected interior baffles, these illustrated in phantom and being formed in a generally arcuate extending array 76. As with the intermediate band, control collapse of the baffle structural array 76 is provided by a series of vents or valve locations 78, 80, 82 et, seq. formed in the manner shown and which respond to compression resulting from the impact event by discharging air or like fluid in a controlled collapsible and force attenuating fashion (following which the baffle or bladder structure 76 can refill/reform to its original configuration in a manner consistent with the valving structure depicted in combination with the other cushioning/force absorbing components).

Similar to the intermediate circular cushioning ring 42, the cross sectional profile of the lower and inner rim extending cushioning member 46 is depicted in line art in FIG. 6 (see irregular lines 84 and 86 depicting the inner and outer undulating walls of the baffle construction with additional outer 88 and inner lines 90 representing the foam edges). The lower extending cushioning member 46 can also include, without limitation, any type of structural support (such as including an inner wire, tensioning element or spine) to assist in providing structural integrity and so that, in combination, the lower rear head supporting member 46 cushions the back of the head and the upper end of the spinal column through the provision of a sandwich construction of elements which can include a mixture of air and foam or other soft material.

Figure 5:
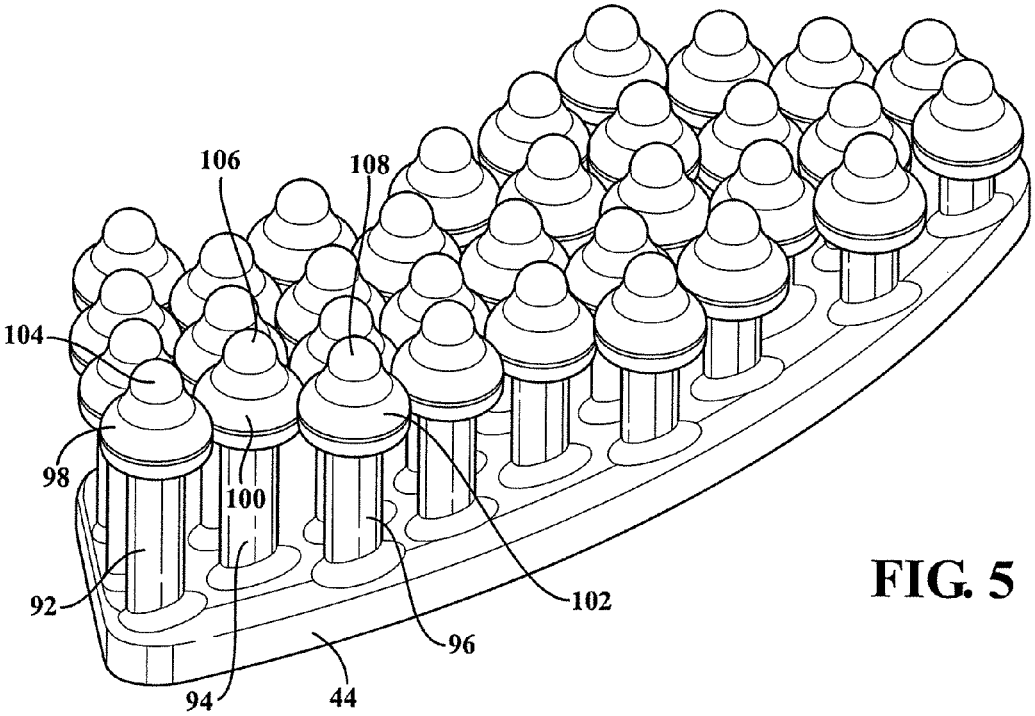
FIG. 5 is an enlarged view of a selected cheek (zygmotic) bone located cushioning support member and better exhibiting the inner surface projecting array of stem supported compressible portions which respond to compressive forces by bending and/or collapsing in combination with increasing their collective diameter dimensions in a counter force attenuating fashion.

As further best shown in FIG. 5, an enlarged view is depicted of a selected one of the pair of cheek (zygomotic) bone located cushioning support members, again shown at 44 and which better exhibits an inner surface projecting array of stem supported compressible portions, see stems 92, 94, 96, et seq., and upon which are mounted upper extending end and increased diameter annular portions 98, 100, 102, et seq. (in informal terms these each illustrating an overall configuration not dissimilar to a bishop associated with a chess set). The construction of the stem supported and compressible portions is such that, in response to compressive forces exerted by the wearers cheek bones to the pad shaped cushioning members 44, the end-mounted annular portions 98, 100, 102, et seq. (these including semi-spherical shaped ends 104, 106, 108, et seq.) deform in a collective combined bending and compressing/widening fashion such that the force of the check/zygomatic bone causes the stem supported portions to increase (widen) their collective diameter dimensions in a counter force attenuating fashion.

As a result, the compressed and flattened portions (see again stems 92, 94, 96, et seq.) progressively exert counter actuating forces against the wearer's face during their collapse with the additional feature being the flattening of the enlarged ends 104, 106, 108, et seq. in a manner which creates a maximum collapse/compression distance which is a dimension above the inner support surface of the member 44. Without limitation, the cheek located support members 44 can be substituted or augmented by additional members located at any other interior supported location of the rigid shell of the helmet.

As previously described, FIG. 3 is an underside rotated view of the helmet in FIG. 1 and illustrates the combination of inner cushioning components of FIG. 2 in combination with the outer lower rim cushioning member, with FIG. 4 further providing a spatially perspective arrayed illustration similar to FIG. 2 with the wearer's head, neck and upper extremities removed and better illustrating the support configuration collectively provided by the collection of inner and outer supporting portions in combination with the hard shell.

Figure 9:
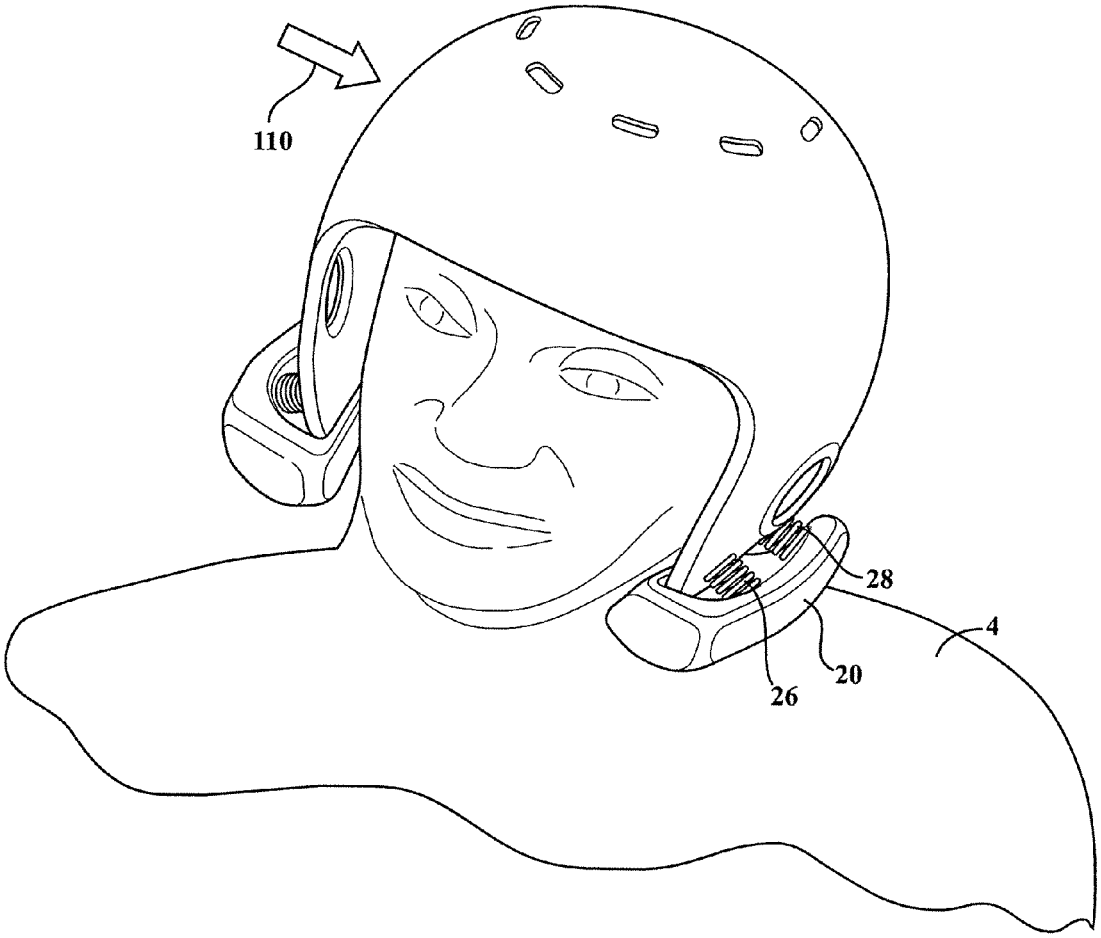
FIG. 9 is an environmental illustration of the helmet of FIG. 1 responding to a side impact event and in which the lower rim extending spring biasing members cushion in counterforce generating fashion against a shoulder of the wearer.
Figure 10:
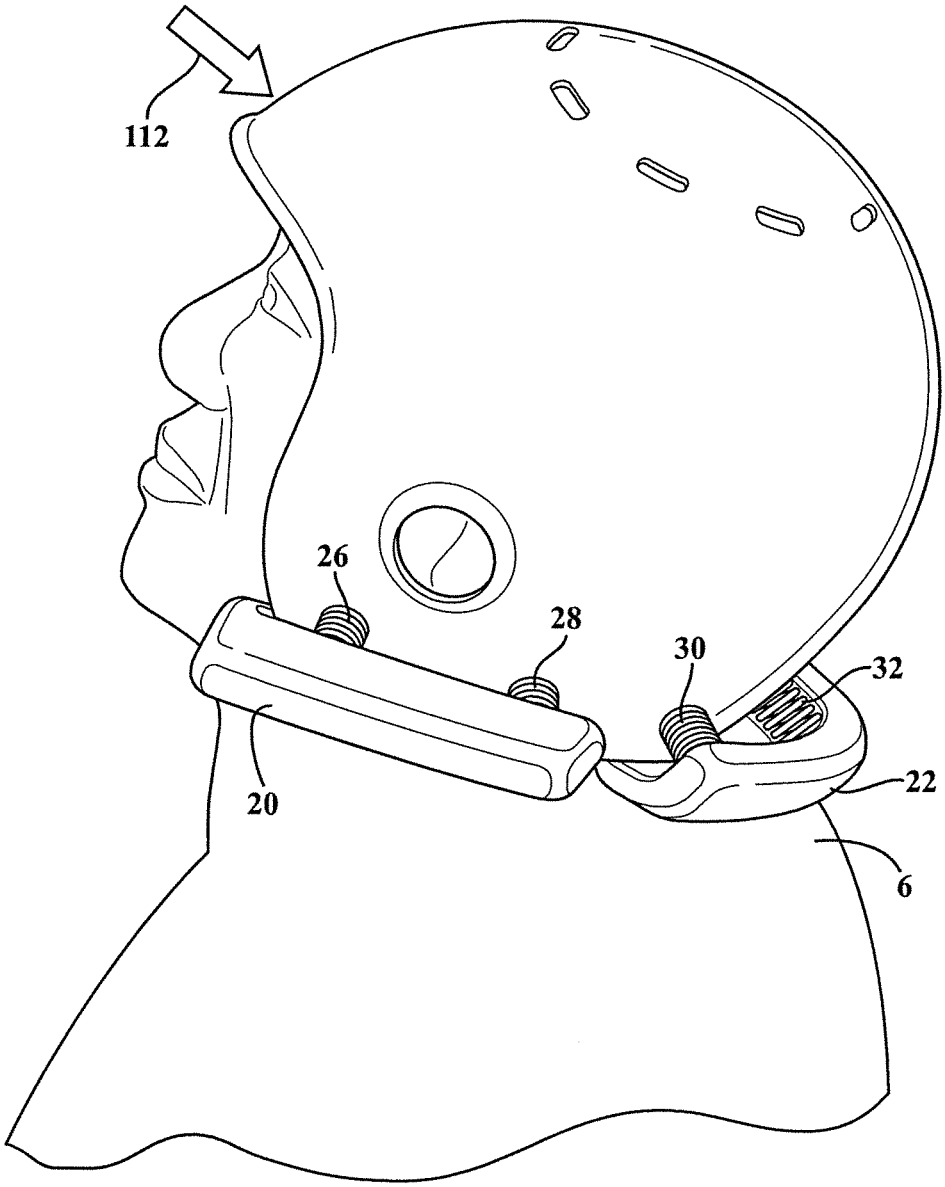
FIG. 10 is an environmental illustration of a front impact event and in which the rear spaced rim extending spring biased member cushions in counterforce generating fashion against the upper back and based of the cervical portion of the spinal column.
Figure 11:
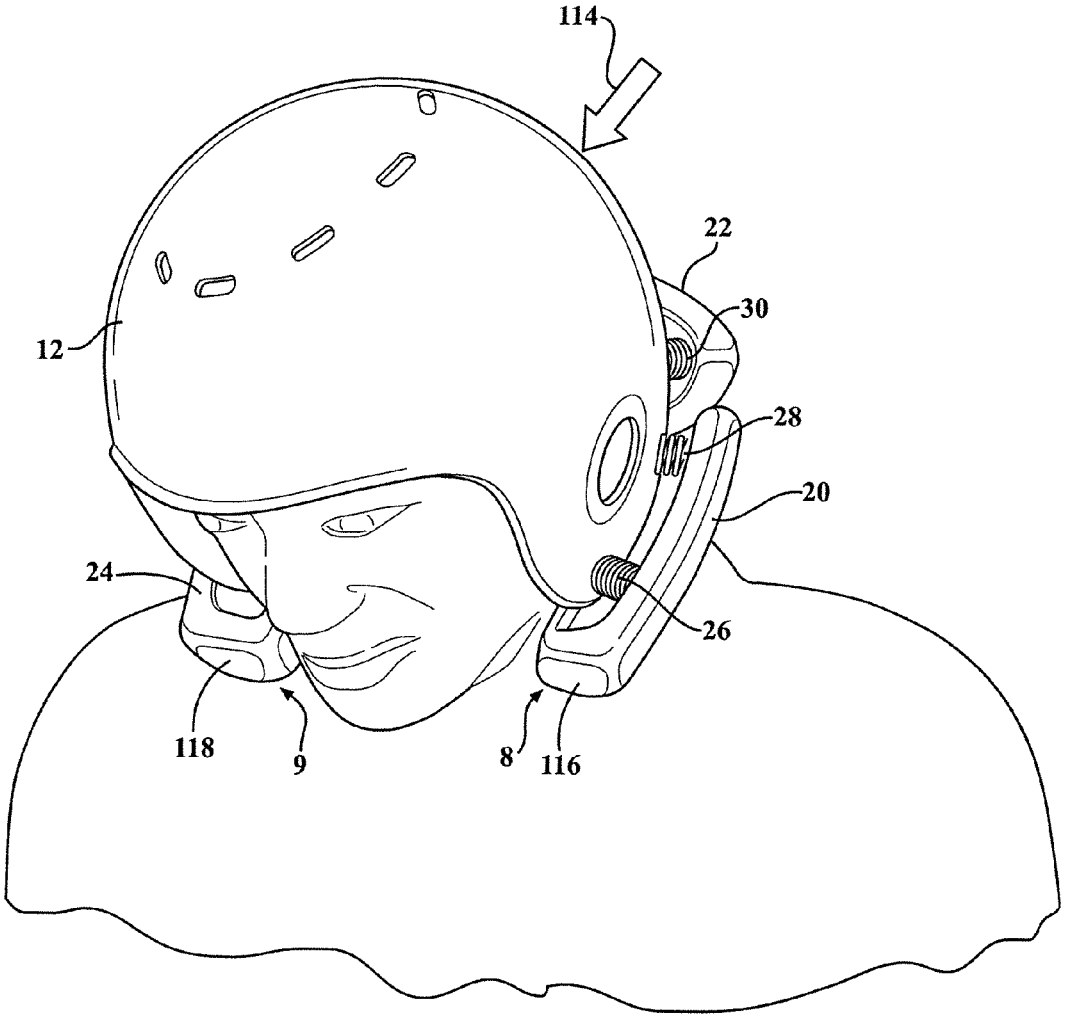
FIG. 11 is a further environmental illustration of a rear impact event in which forward terminating ends of a pair of outermost spaced and rim extending cushioning members bias in counterforce generating fashion against locations of the wearer's collar bone.

Proceeding to the environmental view of FIG. 9, an environmental illustration is shown of the helmet of FIG. 1 responding to a side impact event (see directional arrow 110) and in which a selected one of the lower rim extending spring biasing cushions (shown at 20) is exerted in a counterforce generating fashion against a shoulder 4 of the wearer, again by virtue of the absorbing and reasserting forces exerted by springs 26 and 28. FIG. 10 is an environmental illustration of a front impact event, see directional arrow 112, and in which a rearmost selected 22 of the rim extending spring biased member cushions with associated springs 30 and 32 contact the wearers back 6 in proximity to the cervical portion of the spinal column. Finally, FIG. 11 is a an illustration of a rear located impact (see arrow 114) in which forward ends 116 and 118 outer rim located cushioning members 20 and 24 contact collarbone locations 8 and 9 of the wearer in a flexible and force attenuating fashion.

Figure 12:
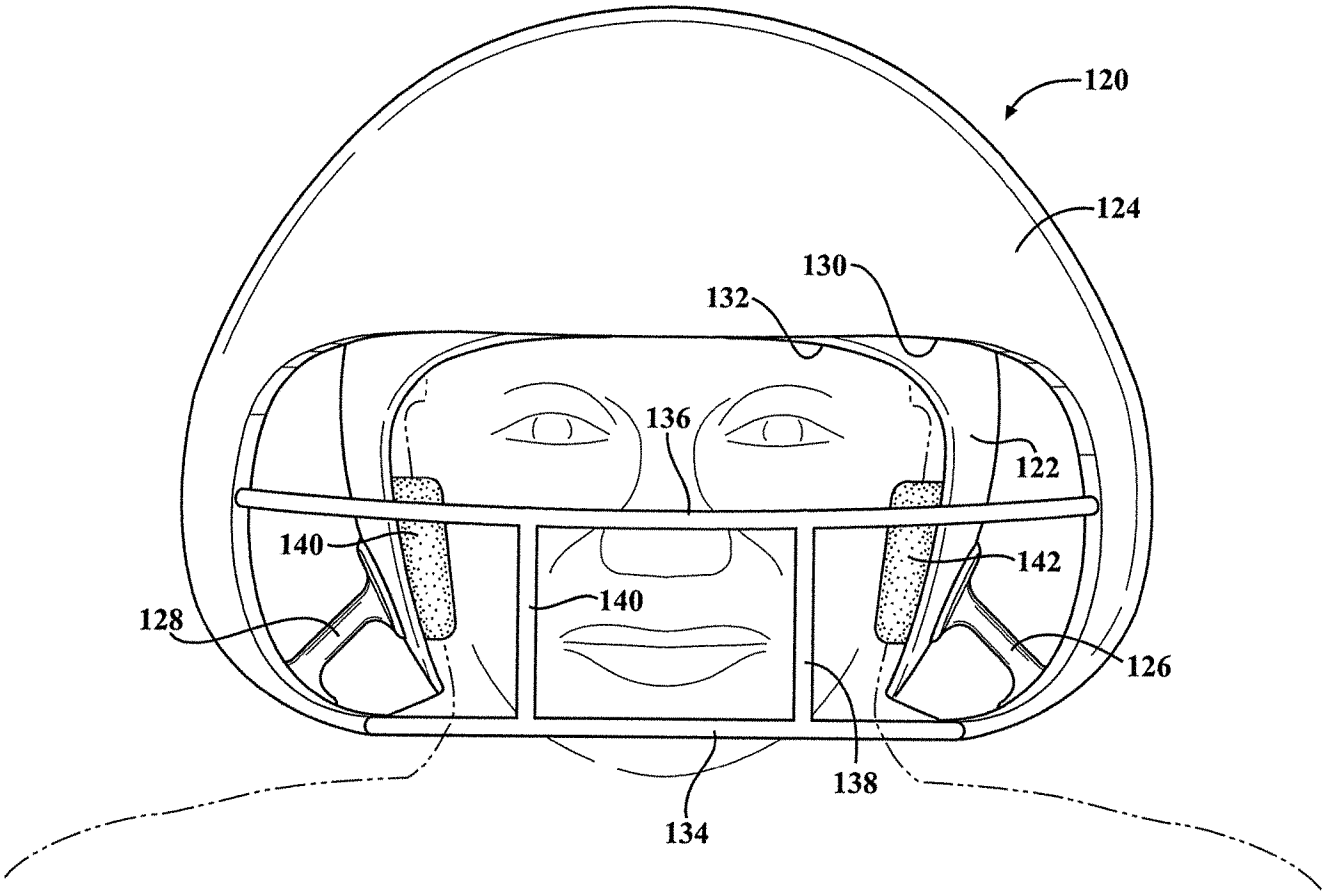
FIG. 12 is an environmental front view of a dual layer helmet construction according to a second embodiment and illustrating a plurality of flexible and elastic support tendons extending between the spaced apart inner and outer rigid helmet layers.

Referring now to FIG. 12, an environmental front view is generally shown at 120 of a dual layer helmet construction according to a second embodiment of the present inventions. The helmet includes an inner rigid layer or shell 122 configured to closely conform to the user's skull, with an outer spaced rigid layer or shell 124 which is resiliently secured to the inner rigid layer 122 via a plurality of flexible and elastic support tendons or spatially defining columns (see pair at 126 and 128) extending between the spaced apart inner 122 and outer 124 rigid helmet layers.

Either or both the rigid inner and outer layers can be constructed of any type of plastic, carbon fiber or other composite material. The layers can further include any complementing forward viewing contours, see at 130 for outer layer 124 and at 132 for inner layer 122 so as to provide an adequate field of vision for the wearer. A faceguard of non-limiting design is depicted by width extending portions 134 and 136 and crosswise extending reinforcing portions 138 and 140. Support pads 140 and 142 are also shown located between the wearer's head and inner mounting surfaces of the inner rigid helmet layer 122 (these being representative of any arrangement of interior supporting pads or cushions for supporting the inner helmet or shell upon the wearer's head).

The construction of the dual layer helmet is further such that headset components including a receiver and/or microphone can be mounted within the space between the inner and outer rigid layers, this being a desirous feature in sporting events such as football or auto racing. The support tendons 126 and 128 (also again termed as support columns as also depicted in related FIGS. 21 and 23) are constructed of any resilient and deformable material, typically a plastic composite, exhibiting the necessary properties of stretchability and which enable the outer rigid layer or shell 124 to stretch in energy absorptive fashion relative to the inner layer by virtue of the plurality of perimeter located tendons.

As further shown, the tendons 126 and 128 are each constructed of a semi-rigid deformable and resilient material, such as including but not limited to any type of plastic selected from a polypropylene material with fiber or other reinforcement, as well as potentially including any of a thermoplastic elastomer (TPE), thermoplastic vulcanizate (TPV) or other construction which provides a desirable degree of flex and/or bend in response to impact events to the outer helmet 124 and to minimize transference to the inner helmet 122 and the wearer's skull and spine. Each of the tendons/columns 126 and 128 further includes a generally polygonal cross sectional, shown as a modified tubular or cylindrical shaped intermediate stem, and which terminates in flattened engaging portions which can be mechanically or chemically secured to opposing surface locations of the outer and inner rigid layers (see inner surface locations of outer rigid layer 124 with inner spaced and outer facing locations of inner layer 122). Without limitation, the elastic tendons can exhibit any other shape or profile which facilitates the resilient and spatially arrayed mounting structure between the inner and outer helmet layers.

Figure 13:
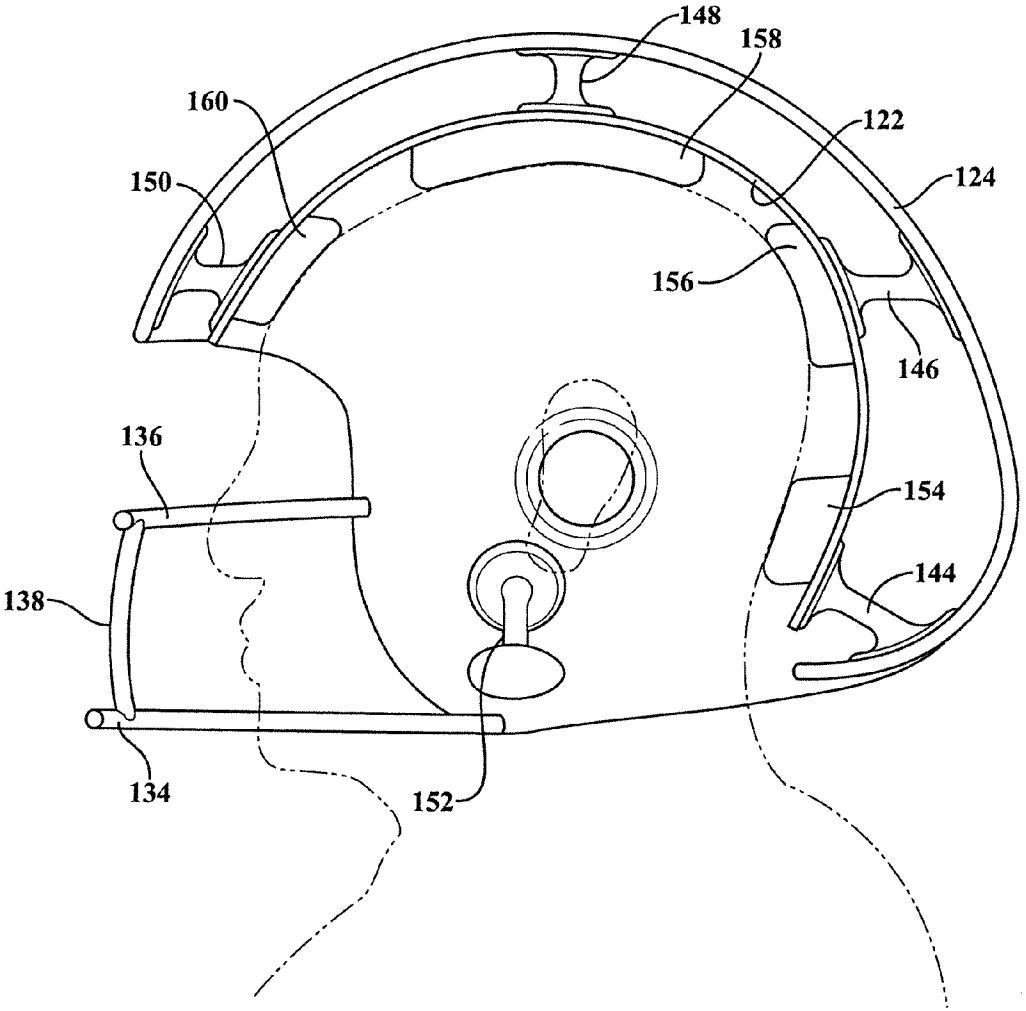
FIG. 13 is a side line art view of the dual layer helmet of FIG. 12 and illustrating an arrangement of the inner bridging support tendons between the inner and outer rigid layers.

FIG. 13 is a side line art view of the dual layer helmet of FIG. 12 and illustrating an arrangement of the inner bridging support tendons, see at 144, 146, 148 and 150, arranged between the inner 122 and outer 124 rigid layers. An additional side located support tendon 152 is shown, with an opposite side located tendon being hidden from view, with the understanding that any number of tendons can be arranged in three dimensional spaced fashion across the separation zone between the inner and outer rigid helmets according to the dynamic environment in which the helmet is utilized. As further defined herein, the term "column" or "support tendon" is intended to include (but not be limited to) any linking component or structure which serves to spatially support the outer helmet or shell 124 around the inner helmet or shell 122, but to do so in such a manner that the tends/columns provide multi-dimensional flex, bend or deformation in response to externally applied impact forces, preventing these impact forces from being directly transferred to the inner helmet 122 and, by extension, the wearers skull, neck and cervical spinal connections, and further doing so in a fashion which provides snap-back or return to the original configuration (i.e. resiliency) upon the force being dissipated or absorbed by the tendon structure.

Also depicted are impact support portions, at 154, 156, 158 and 160, incorporated into the inner rigid layer 122 (i.e. supporting the exterior locations of the wearers head and skull), these being located proximate the mounting locations of the indicated flexible tendons 144, 146, 148 and 150 upon the exterior locations of the inner helmet or shell 122. The impact support portions 154-160 can be constructed of any composite or other force absorbing material, such also potentially including a control collapsible structural foam.

Figure 14:
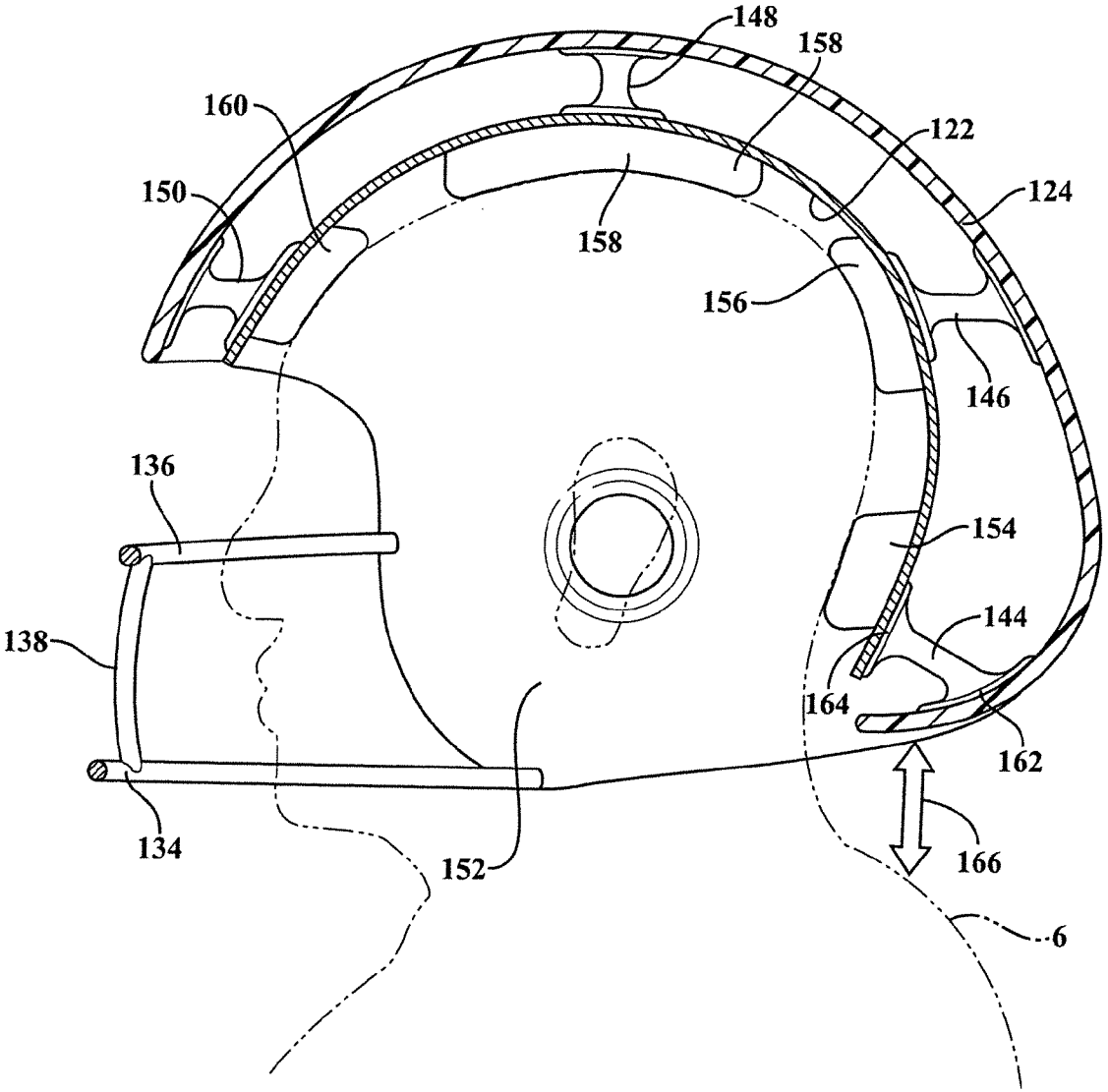
FIG. 14 is a side cutaway of the helmet of FIG. 12.

FIG. 14 is a side cutaway of the helmet of FIG. 12 in a pre-impact condition and which again illustrates the engagement structure of the elastic tendons (see in particular the flattened mounting profiles 162 and 164 of selected tendon 144. Also depicted at 166 is a minimal separation distance established between the lower rear edge of the outer shell 124 and the back 6 (see also FIG. 10) of the wearer, for which the helmet construction provides support in response to a rear rotating of the helmet towards an impact condition with the back).

Figure 15:
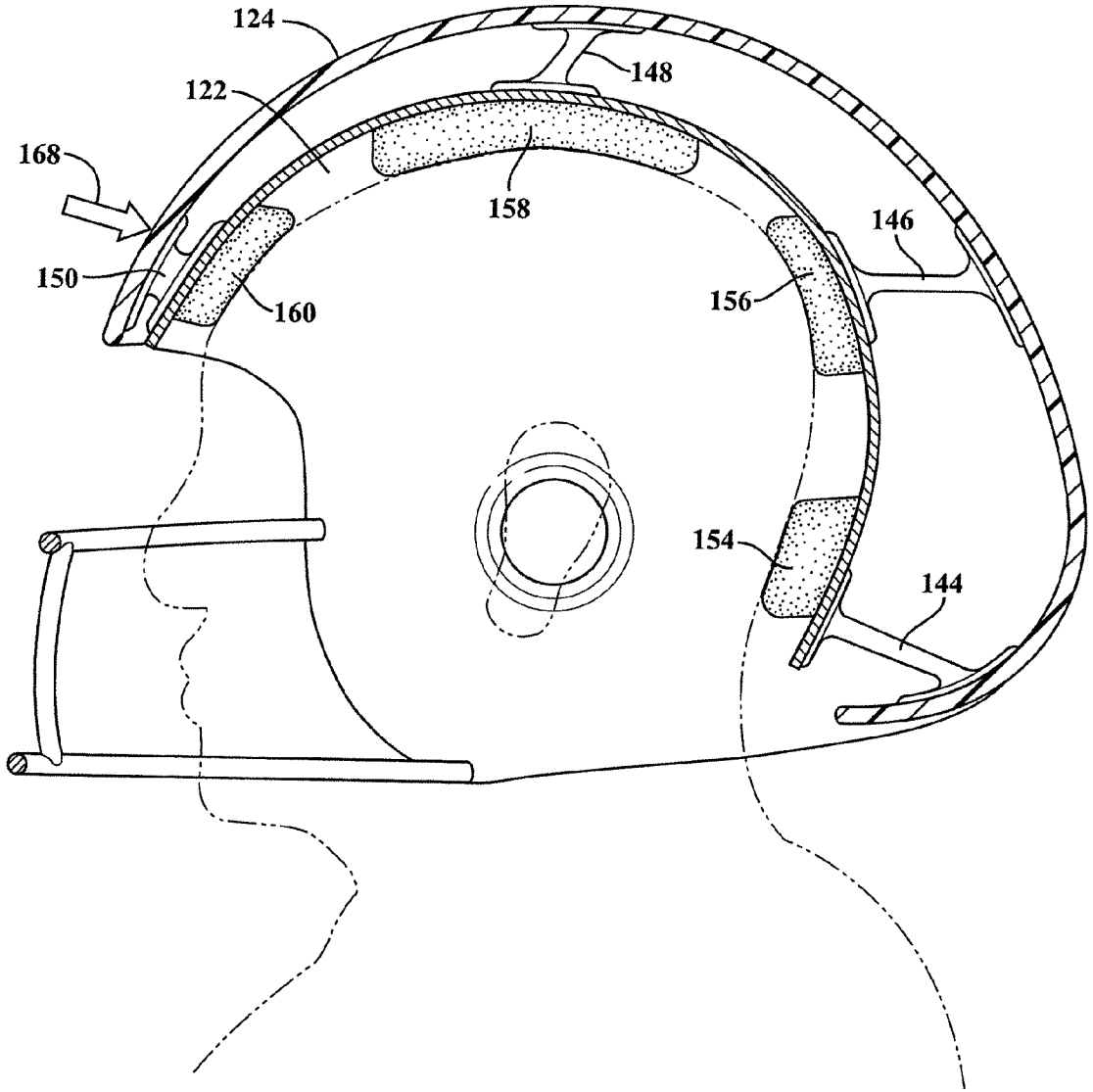
FIG. 15 is a succeeding view to FIG. 14 and illustrating the dynamic deflecting characteristics of the elastic tendon supported outer helmet in response to a forward impact event.

FIG. 15 is a succeeding view to FIG. 14 and illustrating the dynamic deflecting characteristics of the elastic tendon supported outer helmet in response to a forward impact event, see arrow 168. In this depiction, the forward most located support tendon 150 compresses in a fashion which permits the outer rigid helmet layer 124 to collapse in a force absorptive and attenuating fashion in a direction towards the inner helmet layer 122. The rearward spaced tendons 148, 146 and 144 are further shown stretching to varying degrees with the lower/rearward most tendon 144 stretching a maximum distance in which the cross sectional dimensions of the tendon are reduced. The elastic nature of the tendons is further such that the deflection forces exerted upon the outer shell 124 are countered by opposite and attenuating tension forces exerted by the tendons.

Figure 16:
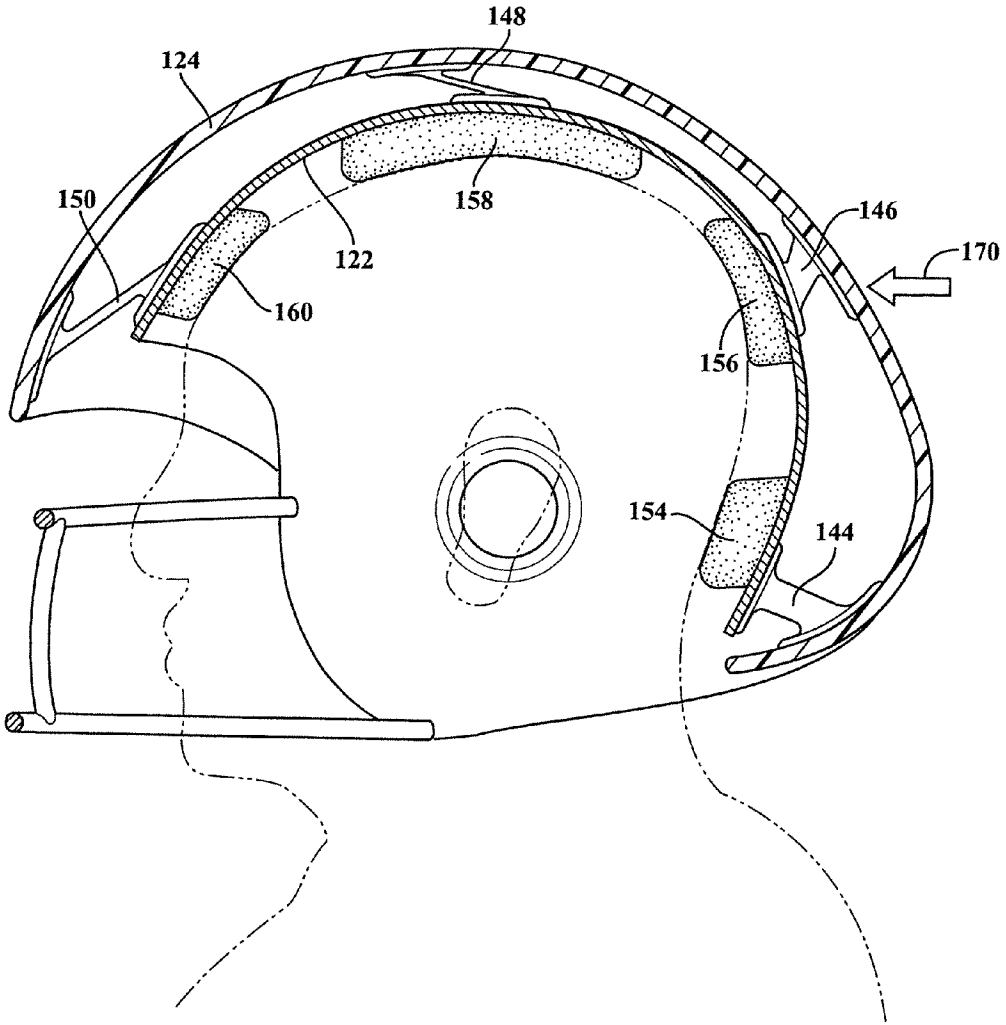
FIG. 16 is an alternate view to FIG. 15 illustrating the dynamic deflecting characteristics of the elastic tendon supported outer helmet in response to a rear impact event.

FIG. 16 is an alternate view to FIG. 15 illustrating the dynamic deflecting characteristics of the elastic tendon supported outer helmet in response to a rear impact event, see arrow 170. In this illustration, the elastic tendons/columns 144, 146, 148 and 150 displace in an opposite (forward) direction, with the forward most tendon 150 stretching forwardly and downwardly in the manner shown. As with the forward impact event of FIG. 15, the rear impact generated event of FIG. 16 is countered by reverse forces exerted by the elastic tendons (e.g. the resilient properties of the tendons absorbing and countering the initial force in a dampening fashion to protect the wearer).

Figure 17:
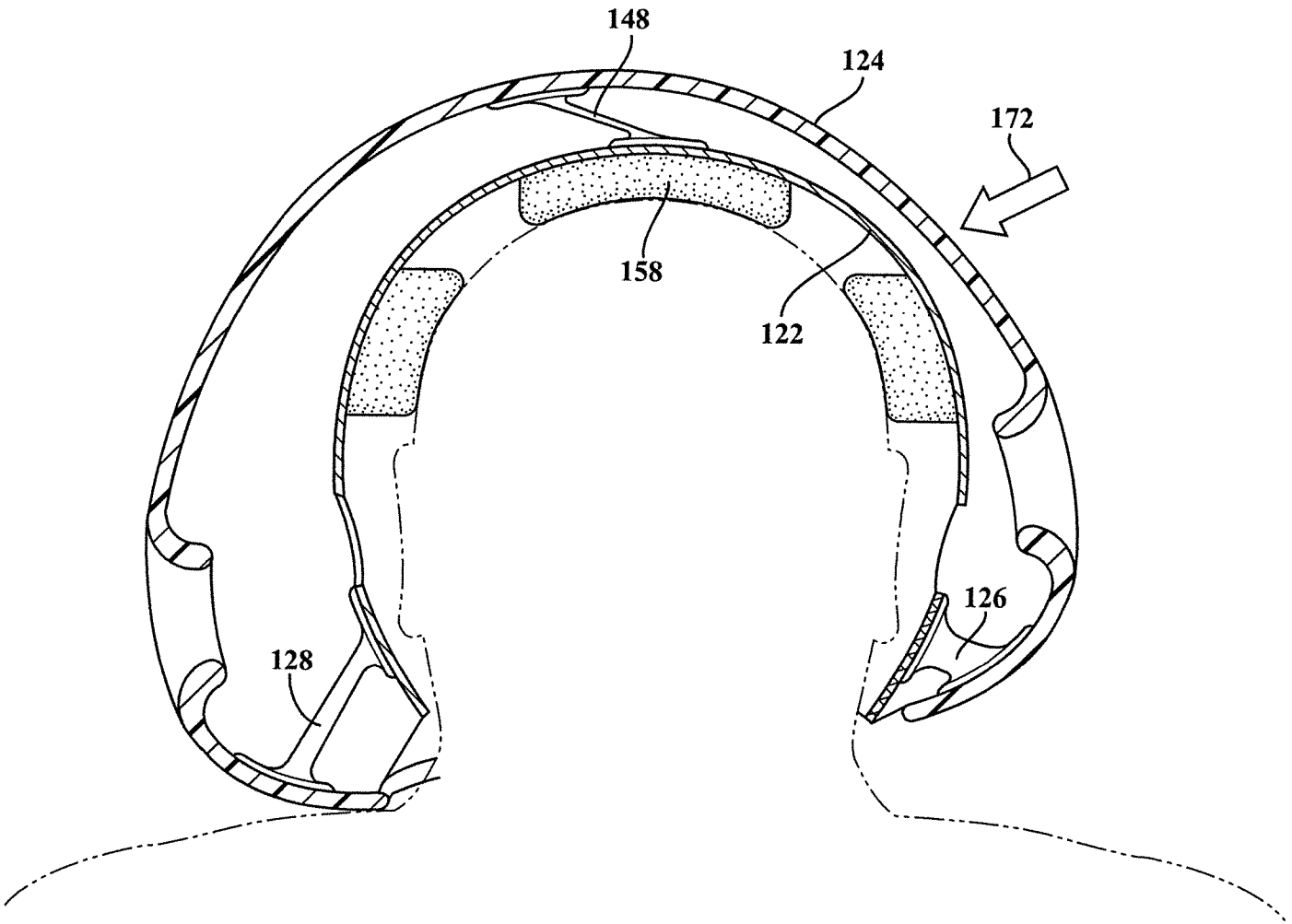
FIG. 17 is an alternate view to FIGS. 15 and 16 and illustrating a side impact event.

FIG. 17 is an alternate view to FIGS. 15 and 16 and illustrating a side impact event (see arrow 172) in which the outer shell 124 is depicted in a (side) lateral displacing and force attenuating condition. The ability to absorb a lateral directed force in the manner shown in FIG. 17 (see compressed side tendon 126 and elongated opposite side tendon 128) enables the wearer's head to avoid absorbing a significant degree of the forces associated with the impact, and such as which can otherwise be transferred to the wearer's neck and spinal column.

Figure 18:
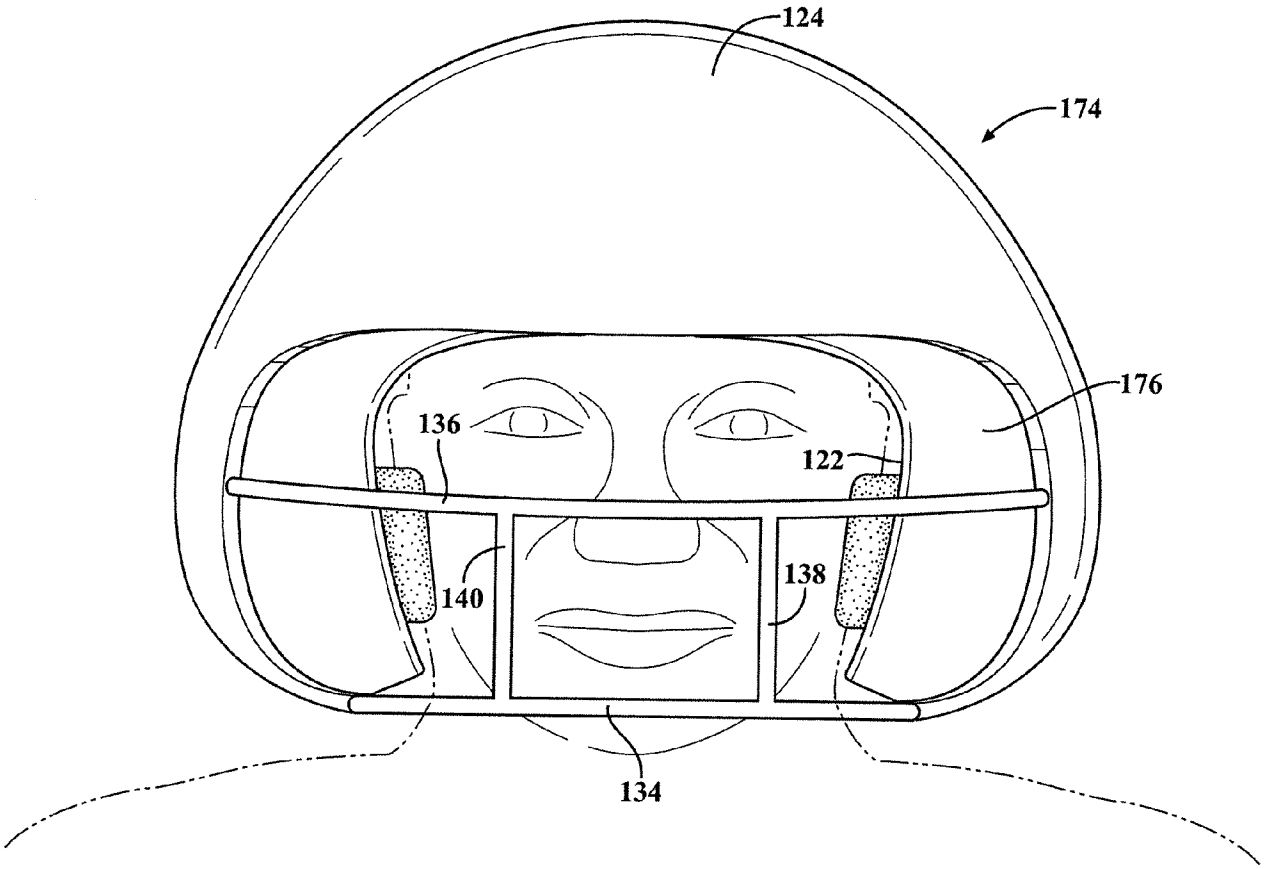
FIG. 18 is an illustration of a dual layer helmet construction according to a third embodiment and illustrating a foam insert positioned between the inner and outer rigid layers alternative to the support tendons shown in FIG. 12.

Proceeding to FIG. 18, an illustration is shown at of a dual layer helmet construction according to a third embodiment and illustrating a foam insert 176 positioned between the inner 122 and outer 124 rigid layers, similar to as previously described however alternative to the support tendons shown in FIG. 12. The foam insert 176 provides impact protection between the inner and outer rigid helmet layers and, without limitation, can include any type of soft, rigid or structural/collapsible composition. The construction of the inner 122 and outer 124 helmet layers can also include any of those previously described (e.g. including an impact resistant plastic such as a heavy duty polypropylene or like material which can include a talc or fiber combination to enhance strength) and can further include any other shape or size.

Figure 19:
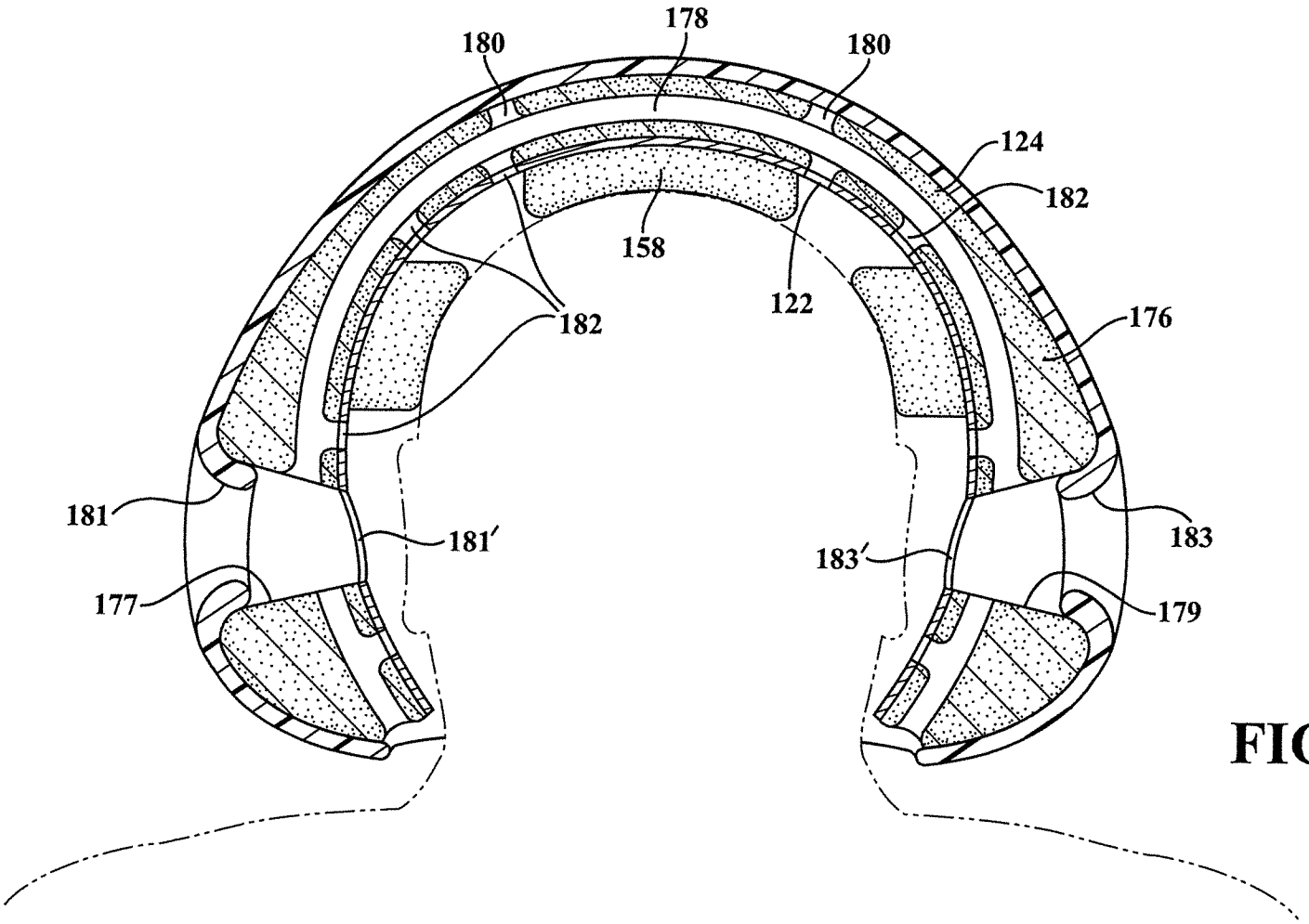
FIG. 19 is a cutaway view of the helmet shown in FIG. 18 and better illustrating the inner and outer rigid helmet layers, intermediate foam support with interior air circulation and venting characteristics, and the inner cushioning pad support configured between the inner rigid helmet layer and the surface of the wearers head.

FIG. 19 is a cutaway view of the helmet shown in FIG. 18 and better illustrating the inner 122 and outer 124 rigid helmet layers and intermediate foam support with interior air circulation and venting characteristics, and the inner cushioning pad support 176, this further being configured between the inner rigid helmet layer and the surface of the wearers head so as to include an air circulation network (see selected perimeter extending main channel 178 in two dimensional cutaway with outer 180 and inner 182 spaced cross channels for providing ventilation to the user's head). Also again shown are inner structural pads associated with the inner helmet layer 122 and such as shown at 158 which are arranged in such a way that they do not impede the ventilation aspects of the helmet assembly. Also depicted at 177 and 179 are earholes defined by inner perimeter surfaces configured within the foam insert or pad support 176, and which communicate with one or more of the main ventilation channels 178 as well as aligning side holes 181 and 183 in the outer helmet which communicate through additional aligning holes (see inner perimeter walls 181' and 183') in the inner helmet.

Figure 20:
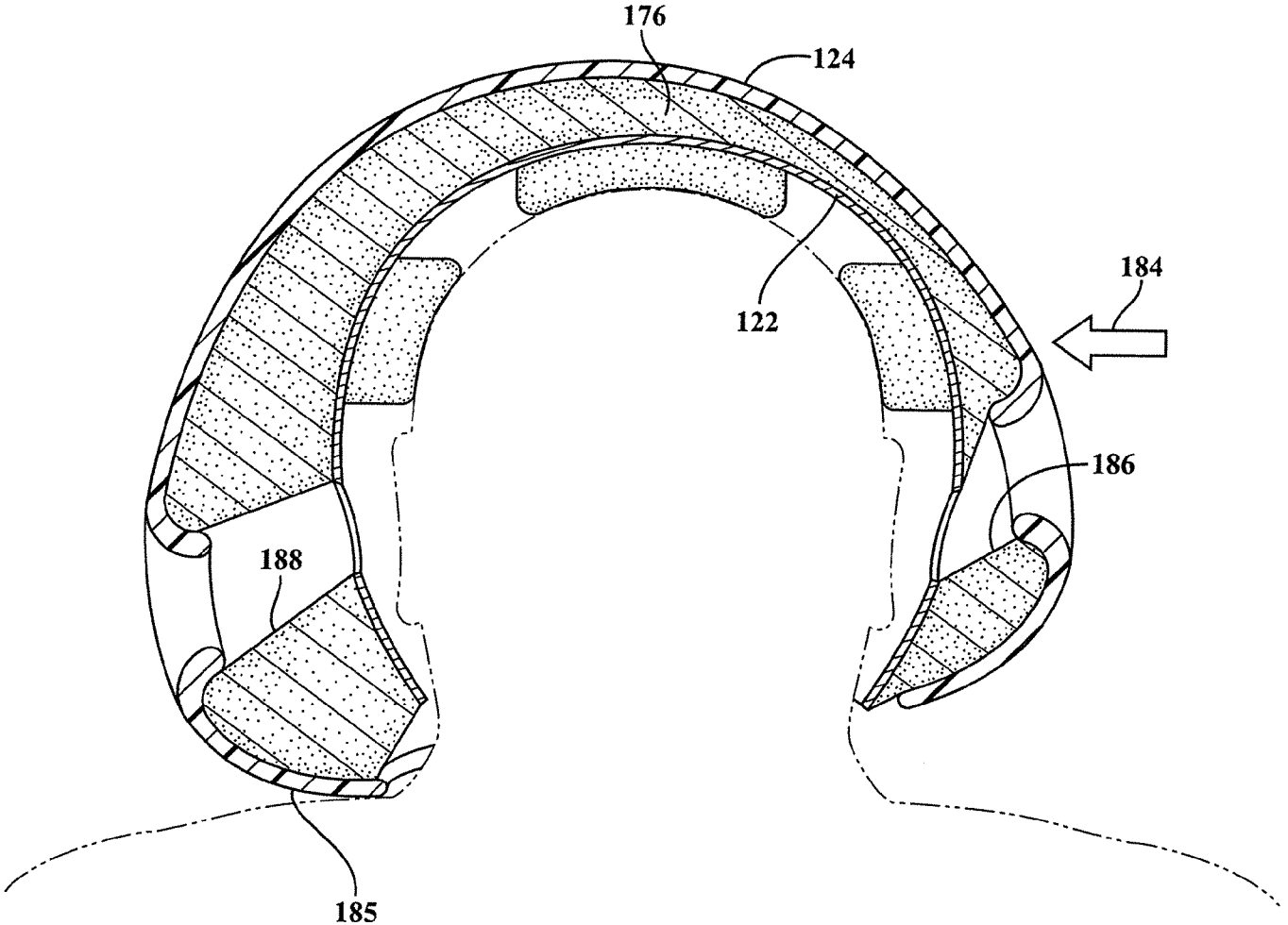
FIG. 20 is a succeeding illustration to FIG. 19 and illustrating the dynamic characteristics of the helmet in response to a side-impact event.

FIG. 20 is a succeeding illustration to FIG. 19 and illustrating the dynamic characteristics of the helmet in response to a side-impact event (see directional arrow 184), in which the outer rigid layer 124 is shifted laterally in the direction shown and so that the foam construction 176 absorbs the impact forces in an attenuating and counter exerting fashion (see compression of foam on left side of helmt) to prevent unnecessary forces being exerted against the user's head and neck (see contact location 185 between the helmet side edge and shoulder which minimizes the degree of bending motion absorbed by the user's head). Also again depicted are ear hole locations again established by inner perimeter walls in the foam 186 and 188.

Figure 21:
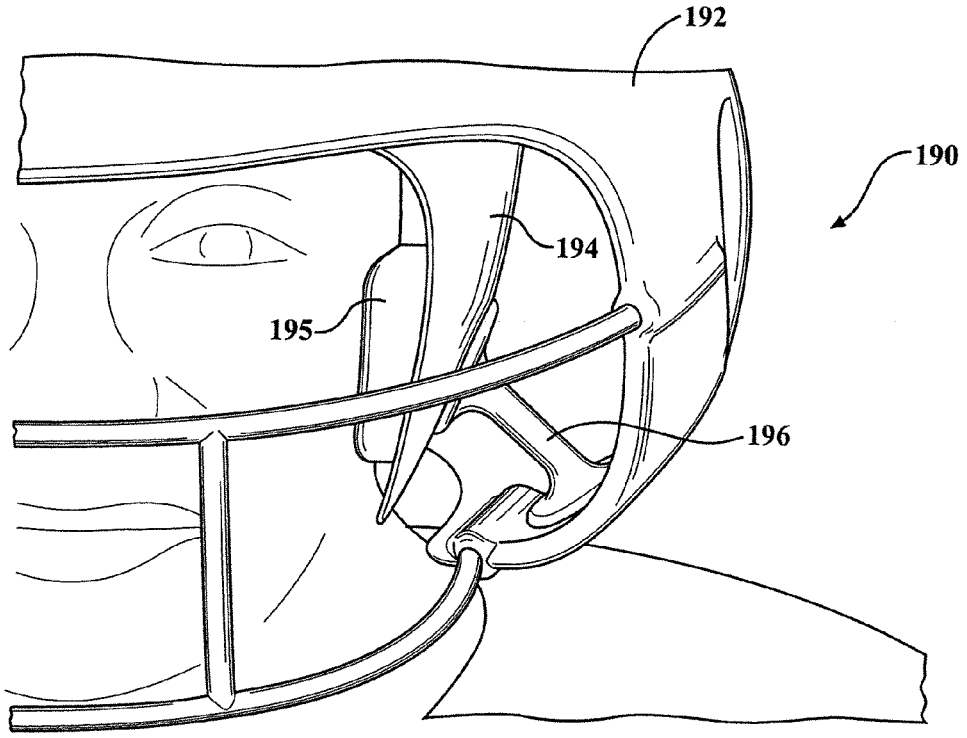
FIG. 21 illustrates a further partial illustration of a dual layer helmet according to a yet further variant and further showing an energy absorbing column support extending between the layers and, upon the outer helmet experiencing an impact event, providing for multi-directional energy absorbing properties.

Proceeding now to FIG. 21, an illustration 190 is generally referenced of a partial illustration of a dual layer helmet (including outer helmet 192 and inner helmet 194) according to a yet further variant and further showing an energy absorbing column support (tendon) 196 of similar construction to that previously described and extending between the layers or shells 192/194 such that, and upon the outer helmet experiencing an impact event, the assembly provides for multi-directional energy absorbing properties. As previously described, the tendons or supports can exhibit any desired force dampening or attenuation structure which facilitates multi-dimensional displacement of the outer helmet 192, in response to an impact event, while minimizing the force transferred to the inner helmet (layer or shell) 194 and the wearer's head via the inner supporting cushioning locations, see further at 195.

Figure 22:
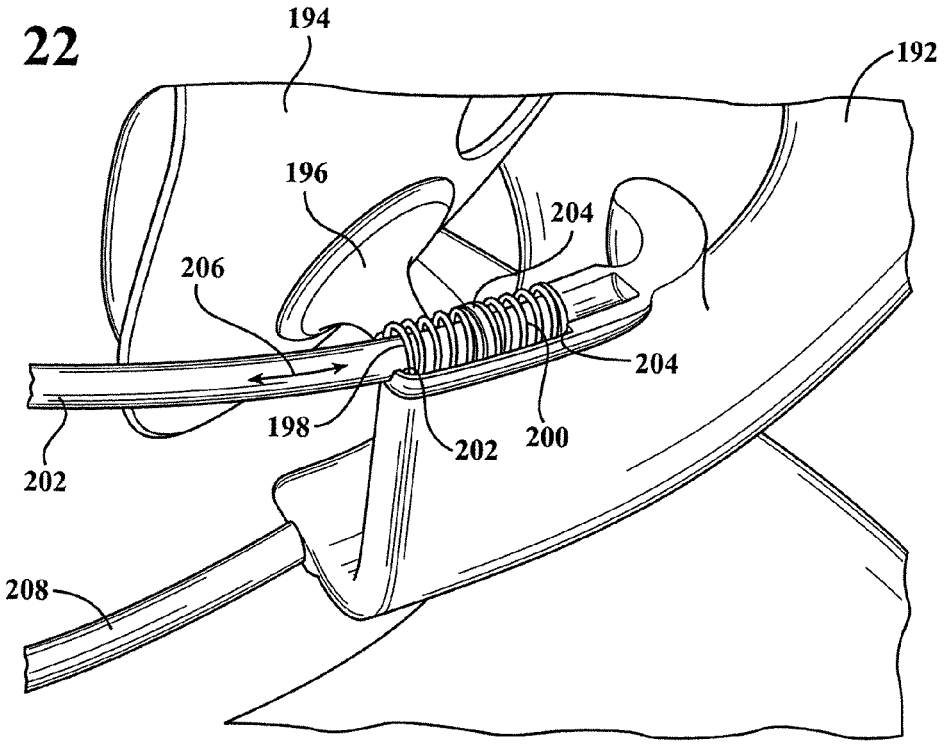
FIG. 22 is a further rotated partial perspective in cutaway of the helmet of FIG. 21 and illustrating a dual compression spring arrangement associated with a given face mask mounting location with the outer helmet, such providing for bi-directional force absorbing displacement.

FIG. 22 is a further rotated partial perspective in cutaway of the helmet of FIG. 21 and illustrating a dual compression (coil) spring arrangement, see springs 198 and 200 associated with a given face mask mounting location with the outer helmet, such providing for bi-directional force absorbing displacement. A selected face mask portion, depicted by extending curved member 202 includes, at selected cutaway end mounting location, an annular protuberance 204 which separates the springs 198 and 200.

As further shown, a seating profile is defined in the outer shell 192 within which the end portion of the mask member 202 is displaceably supported. The three dimensional profile exhibits annular ends or abutment ledges, at 202 and 204, which (upon seating the end mounting portion of the mask member 202) compress opposite ends of the springs 198 and 200, depending upon the direction of displacement of the mask (see bidirectional arrow 206 representing either of a pushing or pulling force exerted upon the mask member 202). Without limitation, a similar arrangement is configured at the opposite mounting end of mask member 202, as well as first and second corresponding mounting ends of a lower extending mask member 208.

Figure 23:
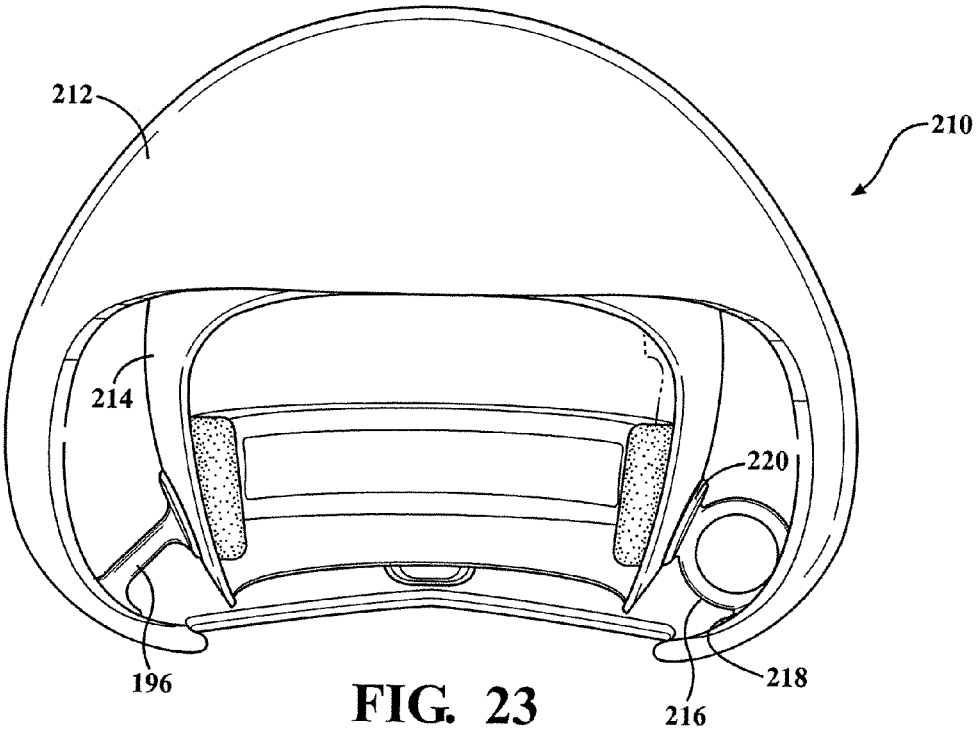
FIG. 23 is a front view of a related helmet construction to that depicted in FIG. 21 and illustrating a modified construction of a force absorbing component arranged in combination with the energy absorbing column support for supporting the inner and outer helmet layers in spatial fashion, the additional component exhibiting an outer disk for providing optimal force deflection/absorption of impact forces exerted against the outer helmet.

Proceeding to FIG. 23, a front view is shown of a related helmet construction, generally at 210, which is similar to that depicted in FIG. 21 (as well as the related variant of FIGS. 12-20). FIG. 23 illustrates a modified construction of a force absorbing component arranged in combination with the energy absorbing column support or tendon previously identified at 196 for supporting inner 214 and outer 212 helmet layers in spatial fashion. An additional component 216 is illustrated on an opposite side of the helmet construction and exhibits an outer or circular shaped disk with first/outer 218 and second/inner 220 flattened mounting locations securing to the opposing locations of the helmets/shells 212 and 214, again for providing optimal force deflection/absorption of impact forces exerted against the outer helmet 212.

Figure 24:
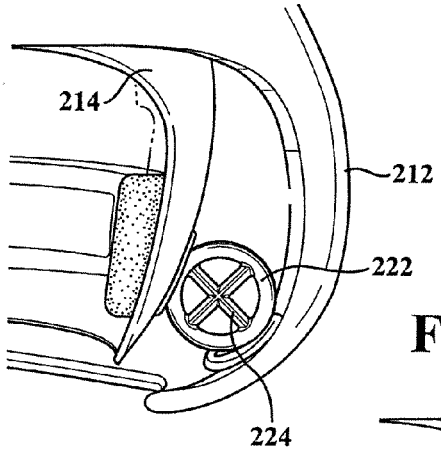
FIG. 24 is partial frontal side illustration of a modification of the force absorbing component in the form of an outer disk in combination with an inner integrally configured cross configuration for providing optimal force deflection/absorption of impact forces exerted against the outer helmet.
Figure 25:
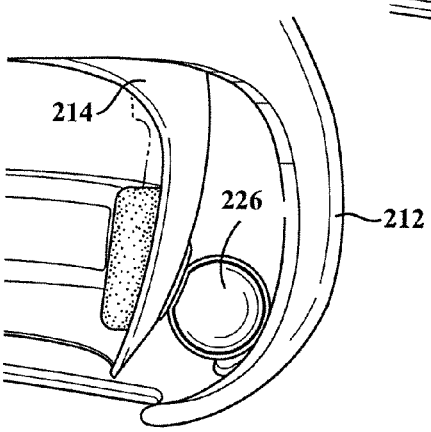
FIG. 25 is a similar view to FIG. 24 and depicting a selected force absorbing component in the configuration of an internally hollow sphere.
Figure 26:
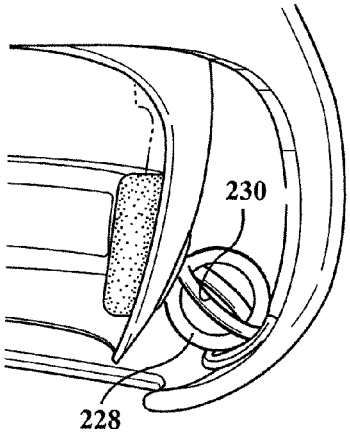
FIG. 26 presents a yet further variant of force absorbing component in the form of first and second disks arranged in rotatably offset and overlapping/intersecting fashion.

FIG. 24 is partial frontal side illustration of a modification of the force absorbing component in the form of an outer or circular disk portion 222 in combination with an inner integrally configured cross configuration 224 for providing optimal force deflection/absorption of impact forces exerted against the outer helmet, again at 212, relative to the spatially and inner supported helmet 214. FIG. 25 is a similar view to FIG. 24 and depicting a selected force absorbing component in the configuration of an internally hollow sphere 226. FIG. 26 presents a yet further variant of force absorbing component in the form of first 228 and second 230 disks arranged in rotatably offset and overlapping/intersecting fashion.

The examples of FIGS. 24-26 are intended to be representative of alternative constructions to that depicted in FIGS. 23, with particular reference to the ring or disk shaped deflecting or force absorbing elements. As with the tendon/column 196, the other shapes also include a resilient plasticized construction and can be configured to provide any desired force absorbing properties consistent with that described above.

Having described my invention, other and additional preferred embodiments will become apparent to those skilled in the art to which it pertains, and without deviating from the scope of the appended claims:

We claim:

1. A helmet, comprising:

a rigid shell adapted to be supported over a wearer's head;

at least one deflecting and force absorbing portion extending from and along a lower rim edge of said rigid shell, each of said deflecting and force absorbing portion having, in cross section, a cupped interior, coiled springs extending from said cupped interior and securing to said rigid shell so that that an extending bottom rim edge of said rigid shell is positioned within the cupped interior and each of said deflecting and force absorbing portion projecting both interiorly and exteriorly of said rigid shell;

an array of interior head supporting and force absorbing portions secured to interior locations of said rigid shell and including an upper most collapsible portion adapted to support a top of the user's head, a cushioning ring array extending around an intermediate perimeter of said rigid shell and adapted to support a crown of the wearer's head, and a semi-circular support adapted to support a base of the wearer's head along a lower rear of said rigid shell and to provide a rear neck support; and upon the wearer experiencing a head impact force exerted on said rigid shell from any direction, bending of a neck of the wearer adapted to being limited by contact between each of said deflecting and force absorbing portion projecting exteriorly and any of a shoulder or upper back of the wearer, concurrent with said array of interior head supporting and force absorbing portions each providing individual and varied controlled collapsing as determined by an angle and direction of the head impact force.

2. The helmet of claim 1, said at least one deflecting and force absorbing portion further comprising a plurality of portions secured to said rigid shell by individual pairs of said coiled springs.

3. The helmet of claim 2, said at least one deflecting and force absorbing portion further comprising a soft outer covering through which each of said individual pairs of said coiled springs are anchored.

4. The helmet of claim 1, said uppermost collapsible portion further comprising a pancake bladder having upper and lower flattened portions interconnected by an intermediate bridging stem portion.

5. The helmet of claim 4, said pancake bladder further comprising any of a soft plastic, thermoplastic elastomer or thermoplastic vulcanizate.

6. The helmet of claim 4, further comprising a fluid medium contained within said pancake bladder and including any of an air or a liquid.

7. The helmet of claim 1, said cushioning ring array further comprising a plurality of individual collapsible portions constructed of a soft plastic with a hollow interior, a vent configured within each of said collapsible portions providing varying controlled collapsing in response to the head impact force.

8. The helmet of claim 7, further comprising a pair of circular extending cables integrated into said cushioning ring array and interconnected by additional crosswise extending cables for reinforcing and structurally supporting said individual collapsible portions within said cushioning ring array.

9. The helmet of claim 1, said semi-circular support further comprising a plastic body with an open baffled interior connected to an exterior via a plurality of vent locations for providing controlled and varying collapsing at locations around said plastic body and resulting from the head impact force by discharging fluid from within said plastic body through said plurality of vent locations.

10. The helmet of claim 1, further comprising a pair of cheek bone cushioning members secured to inside side locations of said rigid shell and adapting to contact cheeks of the wearer.

11. The helmet of claim 10, said cheek bone cushioning members each further comprising a support surface secured to said rigid shell, a plurality of stems and end supported compressible portions extending from said support surface.

12. The helmet of claim 11, said plurality of stems and end supported compressible portions each further including a resilient plastic material and each further comprising a plurality of decreasing diameter locations ranging between a largest diameter proximate an upper end of each said plurality of stems and a smallest diameter defined by a semi-spherical shaped portion located atop each said end supported compressible portions and so that, in response to the head impact force, individual stems of said plurality of stems compress, bend or stretch at varying locations, along with said semi-spherical shaped portions compressing/widening against the wearer's cheeks.

* * * * *